US012359868B2

(12) United States Patent
You

(10) Patent No.: US 12,359,868 B2
(45) Date of Patent: Jul. 15, 2025

(54) REFRIGERATOR

(71) Applicant: LG ELECTRONICS INC., Seoul (KR)

(72) Inventor: Jimin You, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/206,169

(22) Filed: Jun. 6, 2023

(65) Prior Publication Data

US 2023/0314067 A1 Oct. 5, 2023

Related U.S. Application Data

(62) Division of application No. 17/389,519, filed on Jul. 30, 2021, now Pat. No. 11,709,014.

(30) Foreign Application Priority Data

Jul. 30, 2020 (KR) ..... 10-2020-0095408

(51) Int. Cl.
*F25D 23/00* (2006.01)
*F25D 23/06* (2006.01)
*F25D 23/12* (2006.01)

(52) U.S. Cl.
CPC ..... *F25D 23/126* (2013.01); *F25D 23/006* (2013.01); *F25D 23/062* (2013.01); (Continued)

(58) Field of Classification Search
CPC .... F25D 23/126; F25D 23/006; F25D 23/062; F25D 2201/126; F25D 2323/021; F25D 2323/122; F25C 2400/10
See application file for complete search history.

(56) References Cited

U.S. PATENT DOCUMENTS 3,570,266 A * 3/1971 Alvarez ..... F25C 1/00 62/338
2012/0024003 A1 2/2012 Kim
(Continued)

FOREIGN PATENT DOCUMENTS

CN 101512261 8/2009
CN 102472548 5/2012
(Continued)

OTHER PUBLICATIONS

Machine English Language translation of CN 10736380 to ZHeng. Translated Sep. 2024 (Year: 2017).*
(Continued)

*Primary Examiner* — Cassey D Bauer
(74) *Attorney, Agent, or Firm* — KED & ASSOCIATES, LLP

(57) ABSTRACT

A refrigerator includes a cabinet defining an upper storage space, a lower storage space and a machine room provided at a lower end of the cabinet. A dispenser is provided in an upper door of the upper storage space to dispense water or liquid, and an ice maker is provided inside the upper door to make ice. A pump assembly is provided inside the machine room to pump water through a water supply passage from a water tank to the dispenser and the ice maker. The water supply passage extends downward from the water tank after passing through a rear surface of the cabinet to connect to the pump assembly inside the machine room and extends upward from the pump assembly and passes through an upper surface of the cabinet to connect to the dispenser and the ice maker.

18 Claims, 12 Drawing Sheets

(52) U.S. Cl.
CPC .... *F25C 2400/10* (2013.01); *F25D 2201/126* (2013.01); *F25D 2323/021* (2013.01)

(56) References Cited

U.S. PATENT DOCUMENTS

| | | | | |
|---|---|---|---|---|
| 2012/0118001 | A1 | 5/2012 | Mitchell | |
| 2018/0128530 | A1 | 5/2018 | Mitchell | |
| 2018/0195793 | A1 | 7/2018 | Kim | |
| 2018/0347884 | A1* | 12/2018 | Kang | F16K 11/24 |

FOREIGN PATENT DOCUMENTS

| | | | |
|---|---|---|---|
| CN | 106168425 | | 11/2016 |
| CN | 107036380 | | 8/2017 |
| CN | 107036380 | A * | 8/2017 |
| JP | 2002107037 | | 4/2002 |
| KR | 10-2009-0124904 | | 12/2009 |
| KR | 10-2011-0012321 | | 2/2011 |
| KR | 10-2011-0046403 | | 5/2011 |
| KR | 10-2012-0007198 | | 1/2012 |
| KR | 10-2016-0023528 | | 3/2016 |
| WO | WO 2009/035172 | | 3/2009 |

OTHER PUBLICATIONS

European Search Report issued in Application No. 21188479.6 dated Jan. 4, 2022.
U.S. Office Action dated Oct. 5, 2022 issued in parent U.S. Appl. No. 17/389,519.
Chinese Office Action dated Dec. 22, 2022 issued in CN Application No. 202110641637.9.
U.S. Office Action dated Jan. 24, 2023 issued in parent U.S. Appl. No. 17/389,519.
European Office Action dated Feb. 19, 2025, issued in Application No. 23184437.4.

* cited by examiner

REFRIGERATOR

CROSS-REFERENCE TO RELATED APPLICATIONS

This application is a Divisional Application of U.S. patent application Ser. No. 17/389,519 filed Jul. 30, 2021, which claims priority under 35 U.S.C. § 119 to Korean Application No. 10-2020-0095408 filed on Jul. 30, 2020, whose entire disclosures are hereby incorporated by reference.

BACKGROUND

1. Field

Embodiments of the present disclosure relate to a refrigerator.

2. Background

Refrigerators are home appliances that allow low-temperature storage of food or other items (hereinafter "food") in an internal storage space shielded by a door. Refrigerators may be configured to cool the interior of the storage space using cold air generated through heat exchange with refrigerant circulating with freezing cycles.

Refrigerators are increasingly becoming larger and more multifunctional as dietary changes and user preferences become diversified. Refrigerators employ various configurations for user convenience.

For example, refrigerators may include an ice maker capable of making ice by an automatic water supply. In addition, refrigerators may include a dispenser to dispense purified cold water while the refrigerator door is closed.

To supply water to the ice maker and the dispenser, a pipe connected to an external or commercial water supply source may be connected to the refrigerator, and such a refrigerator may be referred to as a direct water supply type refrigerator. However, such a direct water supply type refrigerator may require piping work, limiting an installation location of the refrigerator. In addition, when used in areas where water from a water tap contains lime or has a poor water quality, filters may need to be frequently replaced.

Refrigerators may include a built-in bucket that includes a separate water tank inside the refrigerator and allows a user to fill the water tank with water. Korean Patent Publication No. 10-2012-0007198 discloses a refrigerator having a water container which is detachable to the refrigerating chamber and a pump connected to the water container. A dispenser may be supplied with water from the water container. However, the pump is provided in the inside of the refrigerator to be accessible and/or exposed to the user, which poses safety problems due to fire and exposure.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
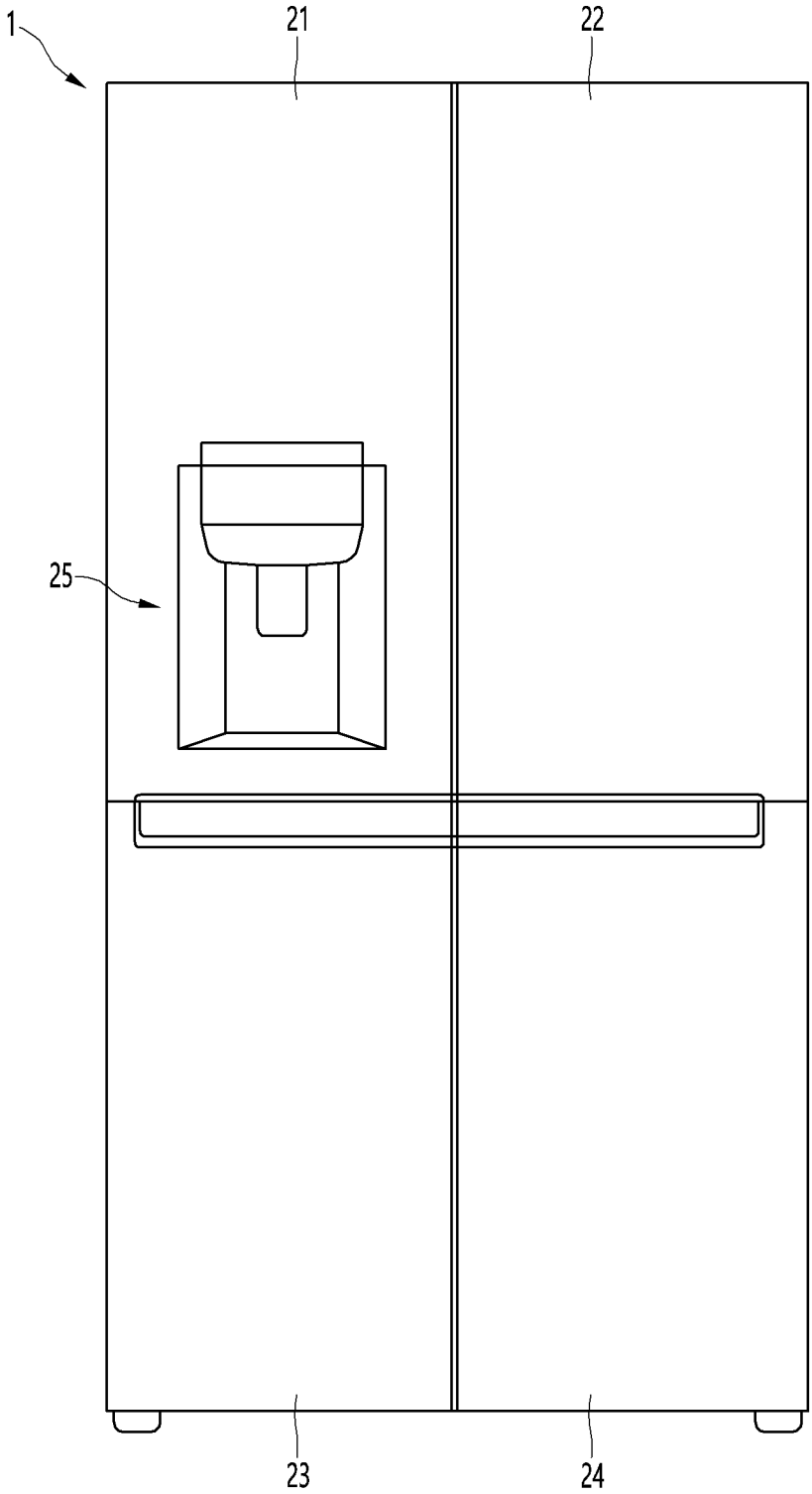
FIG. 1 is a front view of a refrigerator according to an embodiment.

Unless otherwise specifically defined herein, a front direction refers to a direction in which a front surface of a door shown in FIG. 1 faces, a rear direction is opposite to the front direction, a downward direction refers to a direction toward a floor or ground surface on which the refrigerator is provided, and an upward direction is opposite to the downward direction.

Figure 2:
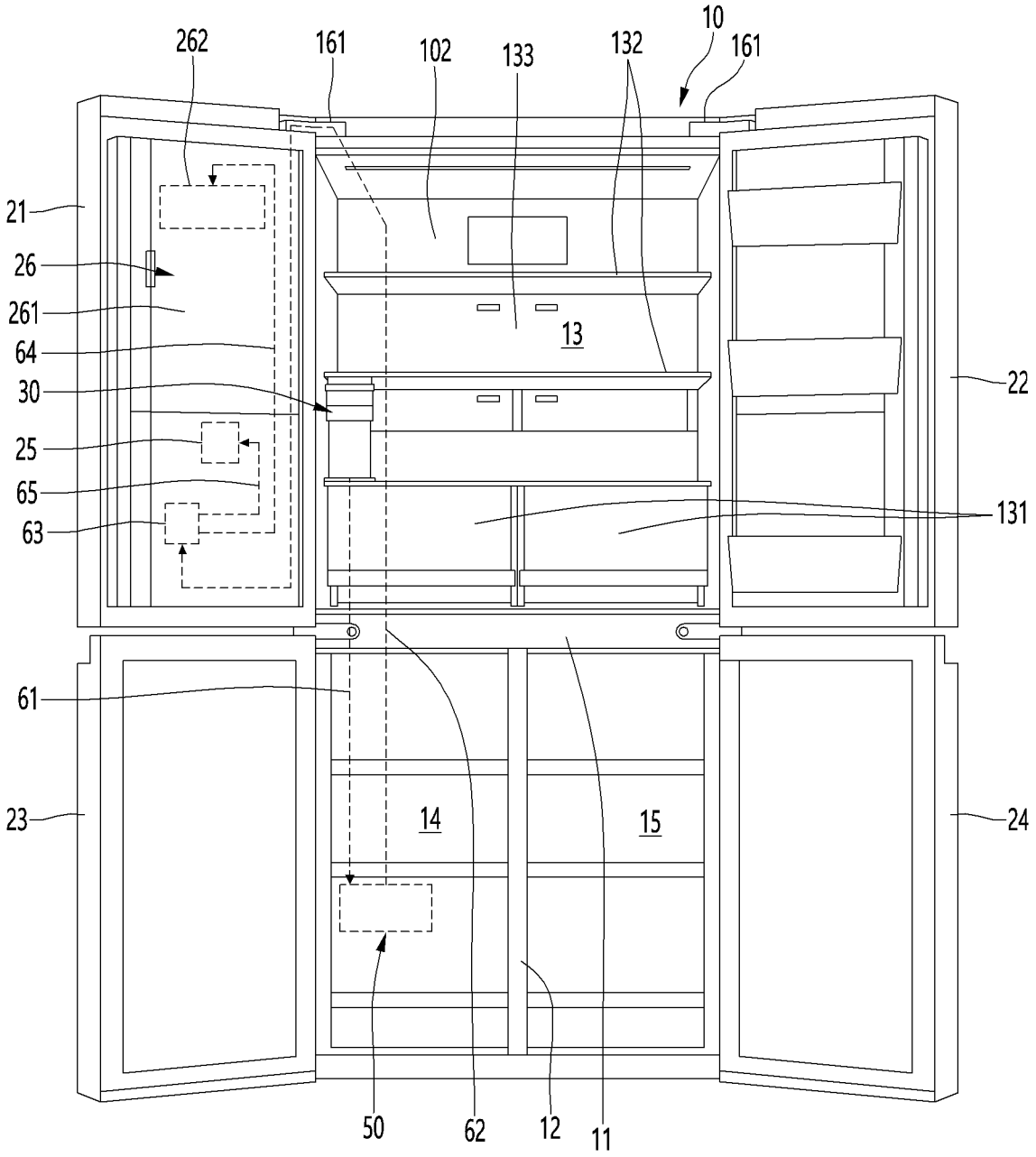
FIG. 2 is a front view of the refrigerator when a refrigerator door is opened.

Referring FIGS. 1 and 2, a refrigerator 1 may include a cabinet 10 defining a storage space and doors 21, 22, 23, and 24 to open and/or close the storage space.

The cabinet 10 may be formed such that a front opening thereof is capable of being opened by the doors 21, 22, 23, and 24. The cabinet 10 may include an outer case 101 made of a steel material defining an exterior appearance and an inner case 102 made of a plastic material defining the storage space inside the outer case 101. A heat insulating material 103 (FIG. 4) may be filled in a space between the outer case 101 and the inner case 102.

The storage space may include an upper storage space 13 and a lower storage space 14 and 15. The upper space 13 may be partitioned from the lower storage space 14 and 15 in the vertical direction by a horizontal partition wall 11. As an example, the upper storage space 13 may be configured as a refrigerating storage space in which frequent usage is required and may be positioned to be easily accessible. In this case, the upper storage space 13 may alternatively be referred to as a refrigerating chamber or space.

The lower storage space 14 and 15 may define a storage space independent from the upper storage space 13 and may be maintained at a different temperature than the upper storage space 13. For example, the lower storage space 14 and 15 may be configured as a freezing storage space to store frozen food and/or otherwise maintained at a lower temperature than the upper storage space 13. In this case, the lower storage space 14 and 15 may alternatively be referred to as a freezing chamber or space.

The lower storage space 14 and 15 may be partitioned in the horizontal direction by a vertical partition wall 12 into a first lower storage space 14 and a second lower storage space 15. The first lower storage space 14 and the second lower storage space may be respectively formed at left and right sides of the partition wall 12. In addition, the first lower storage space 14 and the second lower storage space 15 may be configured or operated to maintain different temperatures. Although the lower storage space 14 and 15 may include two independently maintained first and second lower storage spaces 14 and 15, the first and second lower storage spaces 14 and 15 may be collectively referred to as the lower storage space 14 and 15.

The upper storage space 13 and the lower storage space 14 and 15 may be provided with an upper evaporator 18 (FIG. 4) and a lower evaporator 19, respectively. The upper storage space 13 and the lower storage space 14 and 15 may be subjected to temperature control by independent operations.

The upper storage space 13 may include a storage member having a plurality of drawers 131 and shelves 132. At least one of the plurality of drawers 131 may be provided on a bottom surface of the upper storage space 13, and the drawers 131 may be withdrawn out of and inserted into the upper storage space 13 in the front and rear directions.

The upper evaporator 18 may be positioned behind the plurality of drawers 131, and an evaporator cover 181 may be provided in front of the upper evaporator 18. The upper evaporator 18 may be covered by the drawer 131 to not be exposed to a user, and cold air generated via the upper evaporator 18 may be evenly supplied to the interior storage space of the refrigerator 1 through a cold air duct 133 arranged along the rear wall of the upper storage space 13.

The plurality of shelves 132 may be provided above the plurality of drawers 131. The drawers 131 may be spaced apart by a prescribed interval, and the plurality of shelves 132 may be spaced apart by a prescribed interval. A water or liquid tank 30 may be provided in the upper storage space 13. The water tank 30 may store water or liquid ultimately supplied to a dispenser 25 and an ice maker 262 described below. The water tank 30 may be filled with water by a user's water supply (e.g., external or commercial water supply source).

The water tank 30 may be provided in a space between the drawers 131 and the shelves 132. The water tank 30 may be positioned on the upper surface of the drawer 131 or below the shelf 132 adjacent to the drawer 131 at a position which is suitable considering user convenience and a height of the bottom surface of the upper storage space.

A position where the drawer 131 is provided may also be based on user convenience, but there may be a problem where water stored in the water tank 30 or water in a first water supply pipe 61 connected to the water tank 30 may be excessively cooled due to a proximity between the water tank 30 and the upper evaporator 18. When the water tank 30 is provided at a position above the drawer 131, a position of the water tank 30 and/or the upper evaporator 18 may be configured to prevent or reduce overcooling by the upper evaporator 18.

The upper evaporator 18 may not be provided at the rear of the refrigerator 1 or at a position or height corresponding to the position of the water tank 30. When the upper evaporator 18 is located elsewhere (e.g., above or below the water tank 30), the water tank 30 may be positioned (or extended, for added storage) further rearward. When the water tank 30 is positioned further rearward, the refrigerator 1 may have a slim structure while still storing quite a bit of water and at a position that is convenient in with respect to food stored in the upper storage space 13.

The height of the water tank 30 in the vertical direction may correspond to the height of a position between the drawers 131 and the shelves 132 so that the space between the drawers 131 and the shelves 132 is sufficiently utilized. At such a position, the water tank 30 and/or the refrigerator 1 may have a slimmer structure.

The water tank 30 may be detachably coupled to the tank supporter 34 provided in the upper storage space 13. The water tank 30 may be provided at a first side of the upper storage space 13 that corresponds to a side where the dispenser 25 and ice maker 262 are positioned. For example, the water tank 30 may be provided at a left side of the upper storage space 13 so as to be closer to the left upper door 21 in which the dispenser 25 and the ice maker 262 are provided. In addition, the pump 51 may also be provided at the left side of a machine room 40 to facilitate an efficient arrangement of a water supply passage 60 (FIG. 12) to supply water to the dispenser 25 and the ice maker 262.

At least one door to open and/or close the upper storage space 13 and the lower storage spaces 14 and 15 may be provided at the front side of the cabinet 10. The at least one door may include upper doors 21 and 22 to open and/or close the upper storage space 13 and lower doors 23 and 24 to open and/or close the lower storage spaces 14 and 15. Each of the lower doors 23 and 24 and the upper doors 21 and 22 may be coupled to the cabinet 10 by hinges 161 at the upper and lower ends thereof to open and/or close the upper storage space 13 and the lower storage spaces 14 and 15.

The upper doors 21 and 22 may include an upper left door 21 and an upper right door 22. The upper storage space 13 may be partially or entirely opened or closed by a pair of upper doors 21 and 22. Such an arrangement and/or the upper doors 21 and 22 may be collectively called a French door.

The lower doors 23 and 24 may include a lower left door 23 and a lower right door 24. The lower left door 23 may open and/or close the lower left storage space 14, and the lower right door 24 may open and close the lower right storage space 15.

A dispenser 25 through which purified water is dispensed may be provided at the front side of the upper left door 21. An ice making camber 26 having an ice maker 262 may be provided at a rear side of the upper left door 21. The ice making chamber 26 may be provided inside the left upper door 21 as a heat insulating space 260 to make and/or store ice. The ice making chamber 26 may be opened and/or closed by an ice making chamber door 261. The ice making chamber 26 may be in communication with the dispenser 25 so that ice in the ice making chamber 26 may be passed to the dispenser 25.

A branch valve 63 may be provided inside the left upper door 21 to supply water from the water tank 30 to the dispenser 25 and the ice maker 262. The dispenser 25, the ice maker 262, the branch valve 63, and the water tank 30 may all be provided on the left side of the refrigerator 1 with respect to a center and when viewing a front of the refrigerator 1. The water tank 30 and the pump 51 may be also provided at the left end of the cabinet 10. The dispenser 25 and the ice maker 262 provided in the left upper door 21 and the water tank 30 and the pump 51 provided in the cabinet 10 may provide efficient arrangement for a water supply passage 60.

Figure 3:
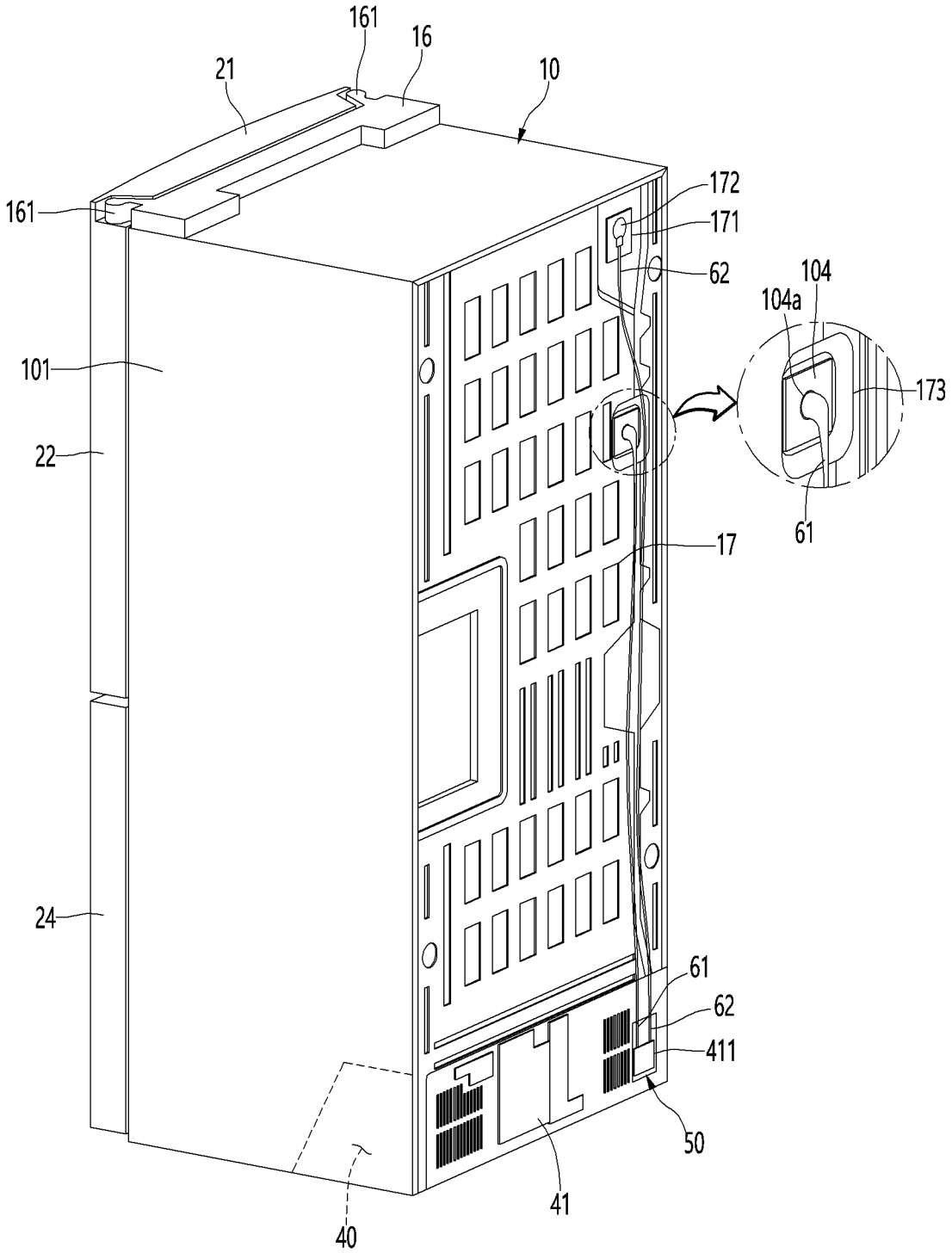
FIG. 3 is a perspective view of the refrigerator when viewed from the rear.
Figure 4:
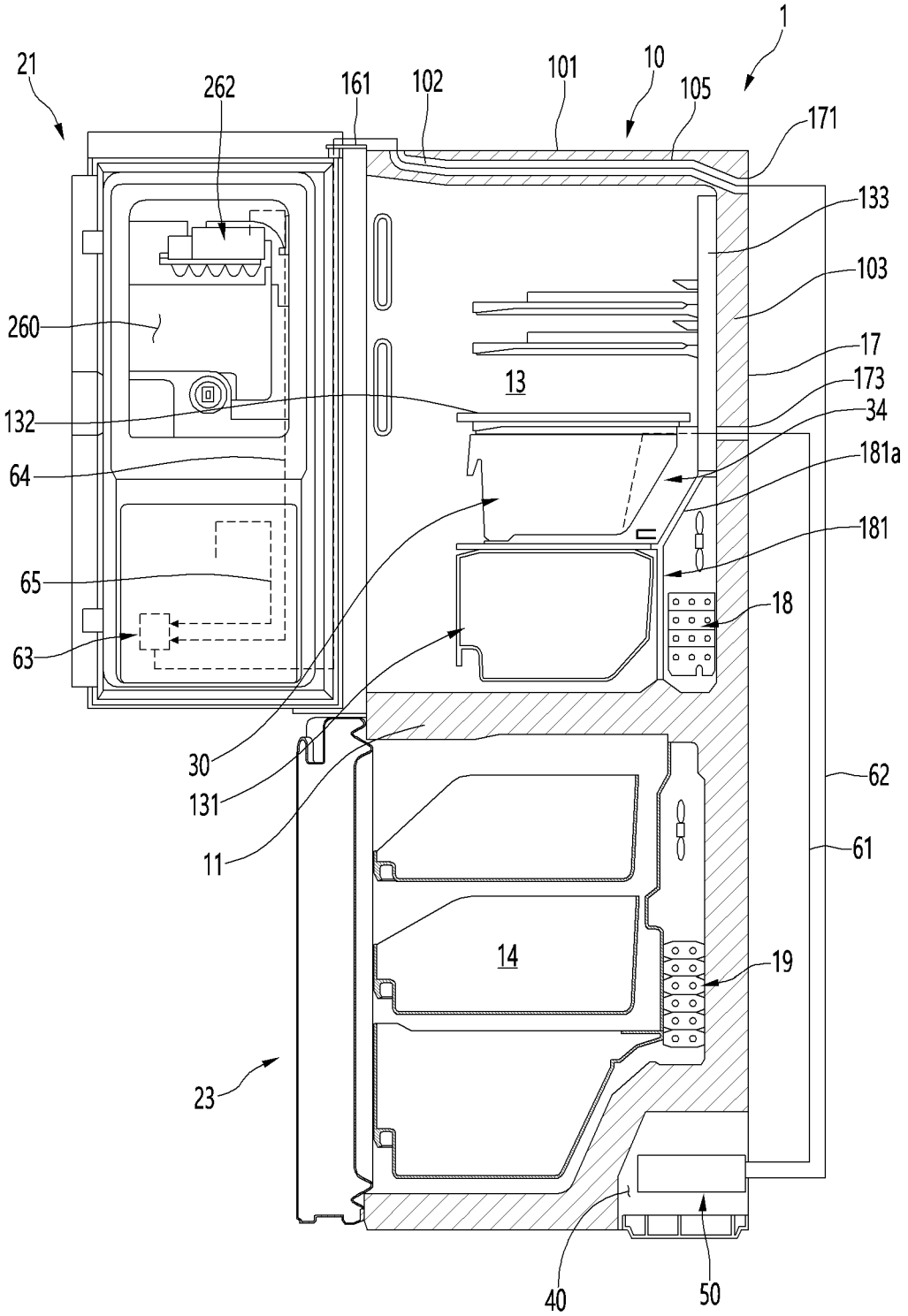
FIG. 4 is a cross-sectional view showing an arrangement structure of the water supply passage of the refrigerator.

Hereinafter, the arrangement structure of the water supply passage 60 of the refrigerator 1 will be described in more detail with reference to the drawings. Referring to FIGS. 3-4, a machine room 40 may be formed at a rear end of a lower surface of the cabinet 10. A compressor and a condenser of a freezing cycle may be provided inside the machine room 40. The machine room 40 may define an independent space separated from the storage space, and an open rear surface may be shielded by a machine room cover 41.

A pump 51 to supply water from the water tank 30 to the dispenser 25 and ice maker 262 may be provided in the machine room 40. The pump 51 may include a brushless motor having a compact size and a long life. As the pump 51 may be provided inside the machine room 40, the pump 51 may not be inside the storage space to be accessible by the user to enhance safety. When the pump 51 is provided inside the storage space, storage capacity may be reduced by the volume of the pump 51.

At least a portion of the pump 51 may be exposed through a cover opening 411 of the machine room cover 41. The pump 51 may be connected to a first water supply pipe 61 extending from the water tank 30 to the pump 51 through the cover opening 411 and a second water supply pipe 62 extending from the pump 51 toward the upper left door 21 (hereinafter referred to as simply "the door 21") through the cabinet 10.

The rear surface of the cabinet 10 may be formed by a back plate 17. The back plate 17 may be coupled to the outer case 101, and the heat insulating material 103 may be filled in a space between the outer case 101, the inner case 102, and the back plate 17.

A lower opening 173 may be formed in the back plate 17 at a position corresponding to or aligning with (i.e., behind) the water tank 30, and a pipe guide member 104 may be exposed through the lower opening 173. The first water supply pipe 61 may pass through a pipe passage 104*a* formed in the pipe guide member 104 to be guided toward the inside of the upper storage space 13.

An end of the first water supply pipe 61 may pass through the rear surface of the inner case 102 and extend to the inside of the upper storage space 13 to connect to a fitting member 35 (FIG. 5) mounted on the tank supporter 34. The first water supply pipe 61 may vertically pass through the rear surface of the back plate 17 and communicate with the water tank 30, which may be provided at a front of the cabinet 10.

The first water supply pipe 61 may pass through the inner case 102 at a position above the upper evaporator 18 and the evaporator cover 181. Water flowing along the first water supply pipe 61 may be prevented from being overcooled by the upper evaporator 18. The first water supply pipe 61 may extend from the rear surface of the cabinet 10 toward the water tank 30 to reduce an extension distance in connecting to the fitting member 35.

An upper opening 171 may be formed above the lower opening 173. The upper opening 171 may be positioned at a height between the upper surface of the inner case 102 and the upper surface of the outer case 101. An upper connector 172 may be mounted in the upper opening 171, and an upper end of the second water supply pipe 62 may pass through the upper connector 172 to be inserted into an area housing the heat insulating material 103.

The upper opening 171, the lower opening 173, and the cover opening 411 may be aligned vertically along a same extension line. The first water supply pipe 61 and the second water supply pipe 62 passing through the upper opening 171, the lower opening 173, and the cover opening 411 may be sequentially arranged in the vertical direction without bypassing a path.

A guide pipe or passage 105 to guide the second water supply pipe 62 may be provided and/or formed inside the heat insulating material 103 on the upper surface of the cabinet 10. The guide pipe 105 may have a hollow tube shape through which the second water supply pipe 62 may pass. A rear end of the guide tube 105 may be connected to the upper connector 172, and a front end of the guide tube 105 may be connected to the upper surface of the cabinet 10 at a position corresponding to the hinge 161. The second water supply pipe 62 may be introduced through the upper connector 172 and may pass through the pipe guide member 104 to be exposed to the upper surface of the cabinet 10 adjacent to the hinge 161.

The second water supply pipe 62 may be guided to the inside of the door 21 by passing through a rotation shaft of the hinge 161 connected to the upper surface of the door 21. A hinge cover 16 covering the hinge 161 and a portion of the second water supply pipe 62 passing through the hinge 161 may be provided on the upper surface of the cabinet 10.

The second water supply pipe 62 may be connected to the branch valve 63 at the lower side of the inside of the door 21. A third water supply pipe 64 connected to the ice maker 262 and a fourth water supply pipe 65 connected to the dispenser 25 may each be connected to the branch valve 63.

Figure 5:
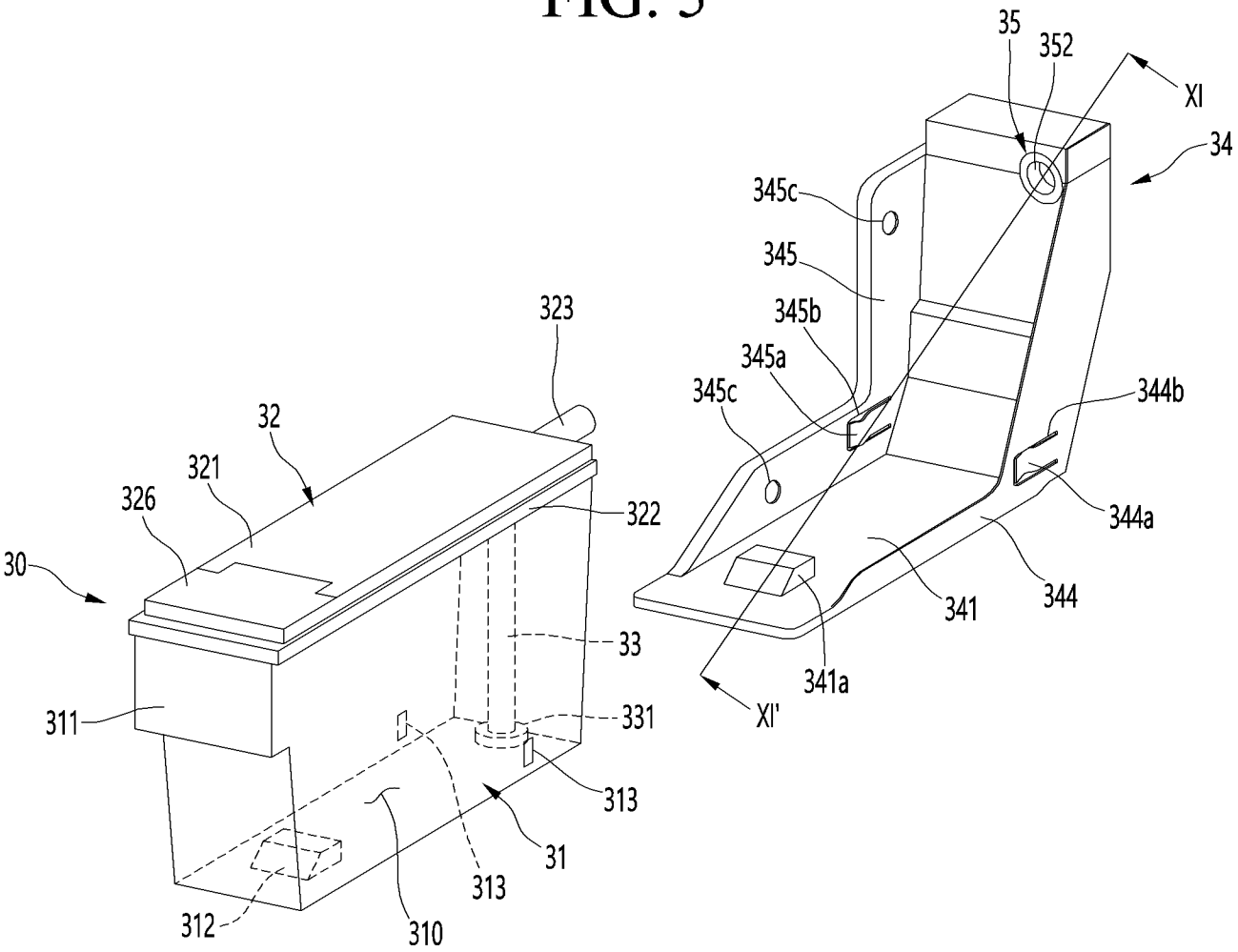
FIG. 5 is an exploded perspective view of a water or liquid tank and a tank supporter or support according to an embodiment.
Figure 6:
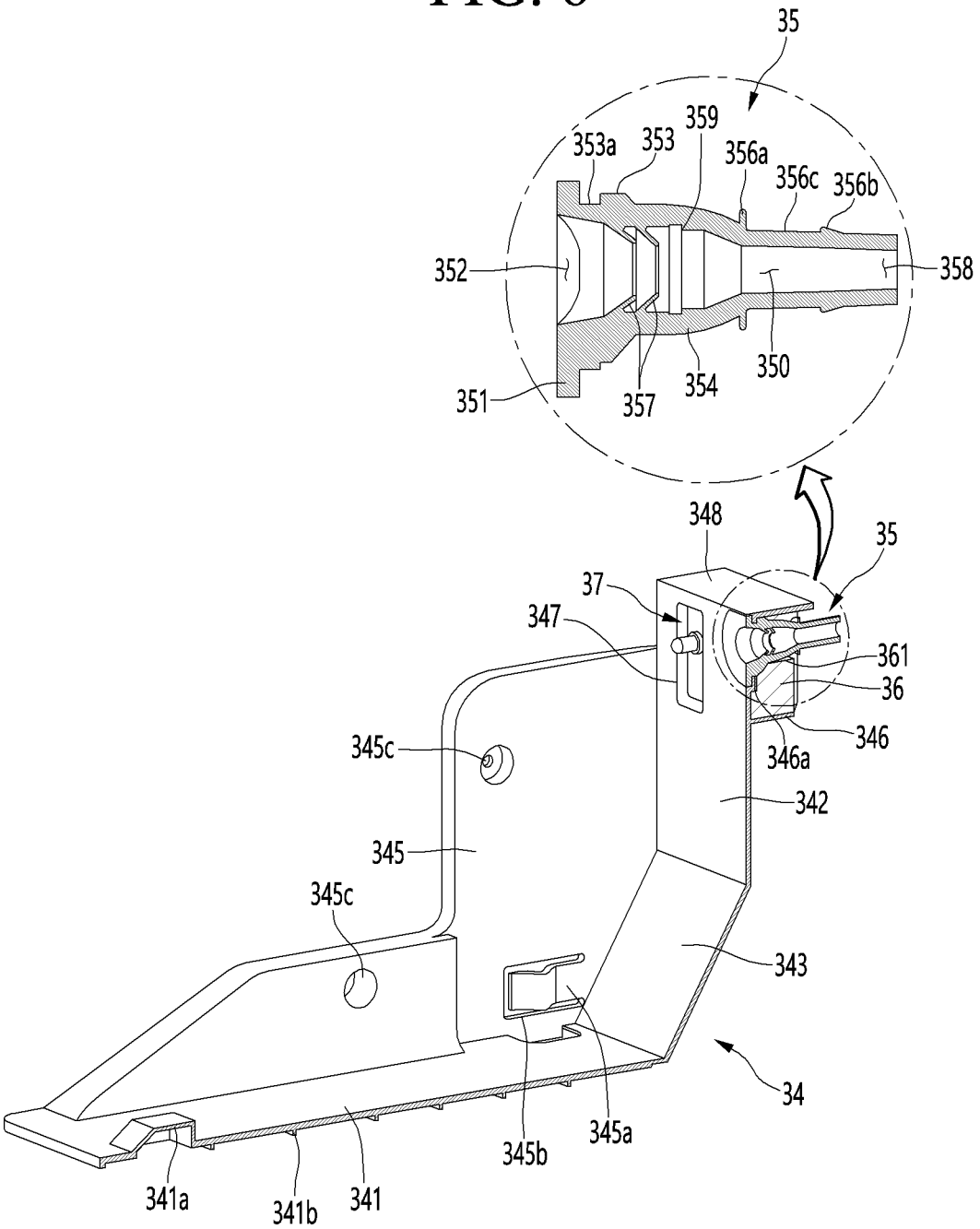
FIG. 6 is a cut-away perspective view taken along line XI-XI' of FIG. 5.
Figure 7:
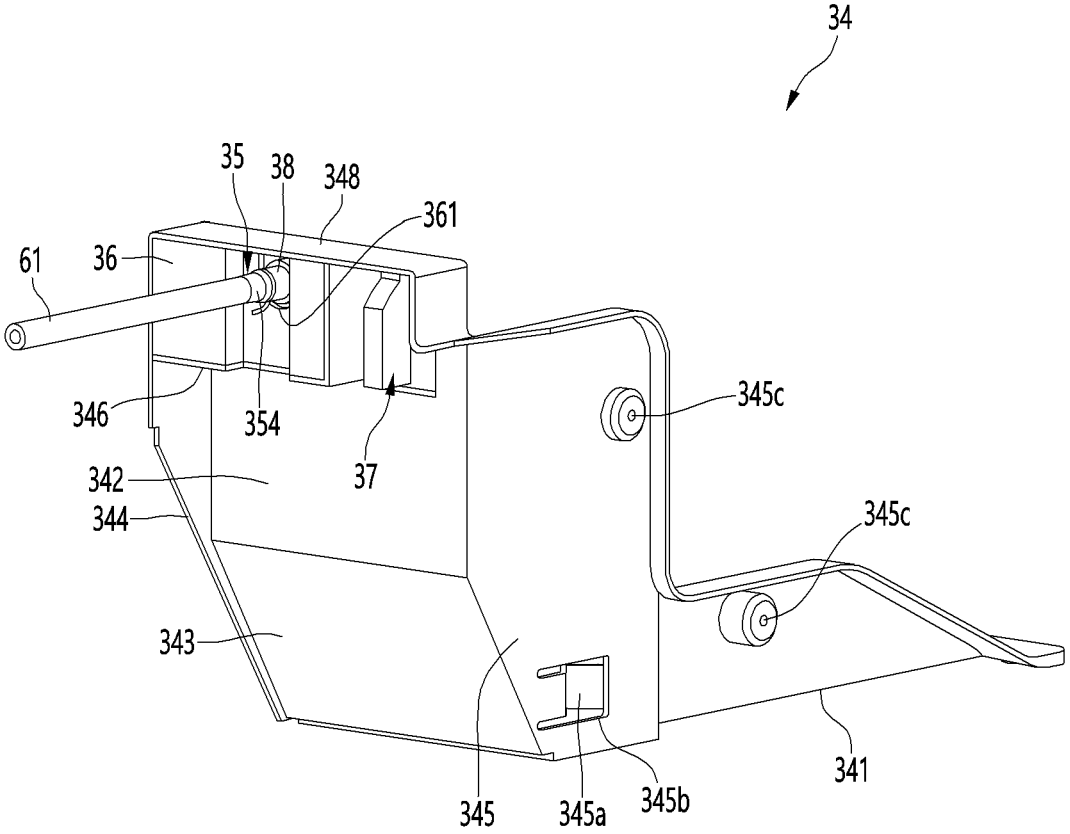
FIG. 7 is a perspective view of the tank supporter when viewed from the rear.

A structure of a water tank module or assembly mounted in the upper storage space 13 will be described in more detail with reference to the drawings. Referring to FIGS. 5-7, a water tank module or assembly may include the water tank 30 and the tank supporter 34 to which the water tank 30 is fixedly mounted. The water tank 30 may be inserted into the tank supporter 34 to be installed or mounted. When the water tank 30 is inserted a prescribed amount into the tank supporter 34, the water tank 30 may be naturally connected to the fitting member 35, and the water stored in the water tank 30 may ready to be supplied to the dispenser 25 and/or ice maker 262.

The water tank 30 may be attached or detached while moving in the front-rear direction. Even in a mounted state, most of the water tank 30 may be exposed to an outside of the tank supporter 34 to be visible to a user looking into the storage space of the cabinet 10 so that a water level inside the water tank 30 may be conveniently checked.

The water tank 30 may include a tank body 31 defining a space in which water is stored and a tank cover 32 covering an open upper surface of the tank body 31. The tank body 31 may be formed of a transparent or translucent material through which a user may see the stored water.

A lower surface fixing groove 312 may be formed in a lower surface of the tank body 31. The lower surface fixing groove 312 may be recessed upward from a bottom surface of the tank body 31. A lower surface of the tank supporter may include a lower surface fixing protrusion 341*a* protruding upward. The lower surface fixing groove 312 may be provided at a position corresponding to the lower surface fixing protrusion 341*a* when the water tank 30 is inserted and mounted in the tank supporter 34. A shape, size, and/or structure of the lower surface fixing groove 312 may correspond to that of the lower surface fixing protrusion 341*a* and/or to enable coupling between the lower surface fixing groove 312 and the lower surface fixing protrusion 341*a*.

Side fixing grooves 313 may be formed at left and right sides of a rear portion of the tank body 31. The tank supporter 34 may include side fixing portions or protrusions 344*a* and 345*a* which may protrude outward from left and right sides, respectively, of the tank supporter 34. The side fixing grooves 313 may be formed at positions corresponding to the side fixing portions 344*a* and 345*a* when the water tank 30 is inserted and mounted in the tank supporter 34. A shape, size, and/or structure of the side fixing grooves 313 may correspond to that of side fixing portions 344*a* and 345*a* and/or to enable coupling between the side fixing grooves 313 and the side fixing portions 344*a* and 345*a*.

When the water tank 30 is mounted on the tank supporter 34, a coupling at the lower surface and both sides of the water tank 30 may be stably maintained. The water tank 30 may remain secured even though a significant portion of the front and side surfaces of the water tank 30 may be exposed to the outside of the tank supporter 34.

A handle 311 protruding forward may be provided on a front surface of the water tank 30. The user may grip the handle 311 to push or pull the water tank 30 in and out of the tank supporter 34.

The tank cover 32 may be configured to shield the open upper surface of the water tank 30. The tank cover 32 may include a cover upper surface 321 having a rectangular shape and a cover rim 322 extending downward along an outer circumference of the cover upper surface 321.

The cover rim 322 may be in close contact with the upper end of the tank cover 32. A gasket may seal the tank cover 32. The tank cover 32 may be optionally configured to be more rigidly coupled to the tank cover 32 with a separate fastener or coupler.

A water supply cover 326 may be formed at the front end of the tank cover 32. The water supply cover 326 may be separated or rotated by a user's operation to open an inlet of the tank cover 32. When the user desires to supply additional water to the inside of the water tank 30, the user may open the water supply cover 326 to initiate a supply of water to the inside of the tank body 31 when the water tank 30 is mounted on the tank supporter 34. However, it is still possible to fill or wash the water tank 30 with water or other liquid even if the tank cover 32 is separated from the tank body 31 and/or when the water tank 30 is separated from the tank supporter 34.

Figure 8:
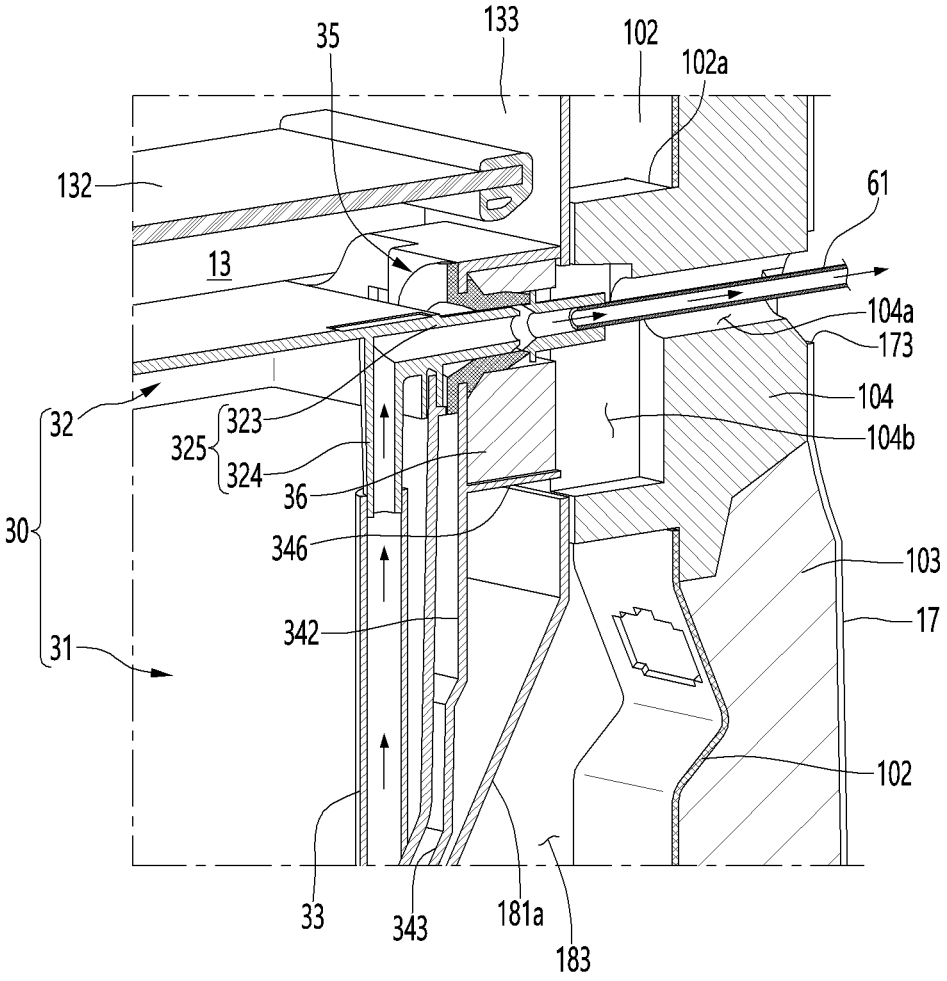
FIG. 8 is a partially cut-away perspective view showing a connection state of a water supply pipe in a state in which the water tank is mounted.

The water tank 30 may include a water outlet 325 (FIG. 8) to discharge water inside the water tank 30. The water outlet 325 may be provided at a rear end of the tank cover 32 and extend to the rear end of the tank cover 32 to be connected to the fitting member 35 when the water tank 30 is mounted. The water outlet 325 may be connected to an extension pipe 33 extending down from the tank cover 32 such that water inside the tank body 31 may be suctioned through the extension pipe 33. As shown in FIG. 8, the water outlet 325 may be integrally molded with the tank cover 32 and include a first water outlet 324 extending downward from the tank cover 32 and a second water outlet 323 extending rearward from the upper end of the first water outlet 324.

The extension pipe 33 may be connected to a lower end of the first water outlet. The extension pipe 33 may extend from the lower end of the first water outlet 324 to the bottom surface of the tank body 31. Even when the water level of the water tank 30 is relatively low, water may still be suctioned through the extension pipe 33.

The extension pipe 33 may be a flexible tube, and a filter 331 may be provided at a lower end of the extension pipe 33. The filter 331 may be configured to filter out foreign substances from suctioned into the extension pipe 33. The filter 331 have an opening formed in a circumference or an upper surface thereof to allow water to be suctioned through the extension pipe 33 when the water level is very close to the bottom surface of the tank body 31.

The second water outlet 323 may extend rearward from an upper end of the first water outlet 324 and from the lower surface of the tank cover 32 through the cover rim 322. The second water outlet 323 may be perpendicular to the first water outlet 324, and interior passages of the first and second water outlets 323 and 325 may communicate with each other to form an integrated passage. When the water tank 30 is mounted on the tank supporter 34, the second water outlet 323 may be inserted into the fitting member 35.

The tank supporter 34 may be configured to receive portions of the lower surface and the rear end of the water tank 30. The tank supporter 34 may be formed of a plastic material, and a lower surface of the tank supporter 34 may be seated on the storage member (e.g., one of the tops of the drawers 131 or shelves 132). A side surface of the tank supporter 34 may be fixed to the inner case 102 of the upper storage space 13.

The tank supporter 34 may include a supporter lower surface 341 forming a bottom surface, a supporter rear surface 342 forming a rear surface, and a supporter inclined surface 343 connecting the supporter lower surface 341 and the supporter rear surface 342. The supporter lower surface 341 may be supported on an upper surface of the drawer 131 and include a plurality of bottom ribs 341*b* protruding downward from to provide a space between the supporter lower surface 341 and the upper surface of the drawer 131.

The supporter lower surface 341 may support the lower surface of the water tank 30. The supporter lower surface 341 may extend in the front-rear direction, and a lower surface fixing protrusion 341*a* may be formed in a first half or side (e.g., front side) of the supporter lower surface 341. The lower surface fixing protrusion 341*a* may have a shape, size, and/or position configured to correspond to that of the lower surface fixing groove 312 recessed in the bottom surface of the water tank 30.

The lower surface fixing protrusion 341*a* may protrude from a center of the supporter lower surface 341 in the horizontal direction and may have a size and shape capable of being inserted into the lower surface fixing groove 312. The lower surface fixing protrusion 341*a* may have an inclination that increases in the front-rear direction. In addition, the lower surface fixing protrusion 341*a* may extend rearward at an inclined upper end of the lower surface fixing protrusion 341*a*. When the water tank 30 is inserted in a rearward direction, the rearward movement of the tank body 31 may be facilitated by the inclination of the lower surface fixing protrusion 341*a*, and the water tank 30 may be secured in a mounted or seated state in the tank supporter 34.

A supporter inclined surface 343 may extend obliquely upward at a rear end of the supporter lower surface 341. The supporter inclined surface 343 may have an inclination corresponding to that of the cover inclined surface 181*a* of the upper surface of the evaporator cover 181. When the tank supporter 34 is mounted, the supporter inclined surface 343 and the cover inclined surface 181*a* may be brought into close contact with each other. Positions of the water tank 30 and the upper evaporator 18 in the upper storage space 13 may be configured and/or coordinated to prevent interference.

The supporter rear surface 342 may extend upward from an upper end of the supporter inclined surface 343 to form a rear surface of the tank supporter 34. The supporter rear surface 342 may extend downward from the upper end of the rear surface of the tank supporter 34 and may extend perpendicularly to the supporter lower surface 341. A mounting hole in which the fitting member 35 is mounted may be formed at a center of the supporter rear surface 342.

The tank supporter 34 may have a supporter left surface 345 and a supporter right surface 344. The supporter left surface 345 may extend upward along the left ends of the supporter lower surface 341, the supporter inclined surface 343, and the supporter rear surface 342 to form the left surface of the tank supporter 34. Left and right side surfaces of the water tank 30 may be supported by the supporter left surface 345 and the supporter right surface 344.

The supporter left side surface 345 may have a predetermined or prescribed width and height and may contact a left side surface of the inner case 102. A plurality of screw fastening holes 345*c* may be formed on the supporter left surface 345, and screws may be fastened to the screw fastening holes 345*c* to fasten the tank support 34 to the inner case 102. The supporter left surface 345 may alternatively be referred to as a supporter mounting surface. The screw fastening holes 345*c* may be positioned at different heights and different front-rear positions to stably support the tank supporter 34 at the side wall of the inner case 102.

A side fixing portion or protrusion 345*a* may be formed at a lower portion of the supporter left surface 345 at a position corresponding to the side fixing groove 313 of the water tank 30. A cutout 345*b* may be cut to pass through the supporter left surface 345 at a portion of the supporter left surface 345, and the side fixing portion 345*a* may be formed to extend from an inside of the cutout 345*b*. The side fixing portion 345*a* may be formed in a plate shape to have elasticity, and when the water tank 30 is mounted, the front end of the side fixing portion 345*a* may protrude inward and be then inserted into the side fixing groove 313.

The supporter right surface 344 may extend upward along right ends of the supporter lower surface 341, the supporter inclined surface 343, and the supporter rear surface 342 to form the right surface of the tank supporter 34. The supporter right surface 344 may have a lower width and height than those of the supporter left surface 345. While the water tank 30 is mounted on the tank supporter 34, the right surface of the water tank 30 may be secured even though the outer surface of the water tank 30 may be exposed to the outside of the tank supporter 34.

A portion of the supporter right surface 344 connected to the supporter inclined surface 343 and the supporter rear surface 342 may be formed to have a relatively larger width than a portion connected to the supporter lower surface 341. The supporter right surface 344 may include a cutout 344*b* and a side fixing portion or protrusion 344*a*. The cutout 344*b* and the side fixing portion 344*a* may be formed at positions facing the cutout 345*b* and the side fixing portion 345*a* of the supporter left surface 345 and have a same or similar structure and shape. The side fixing portions 344*a* and 345*a* at the left and right sides of the tank supporter 34 may be held and restrained by the side fixing grooves 313 of the water tank 30 to resist separation of the water tank 30 and secure a connection of the second water outlet 323 to the fitting member 35.

The fitting member 35 may be mounted at a center of the supporter rear surface 342. The fitting member 35 may be formed of a rubber or silicone material. The inlet 352, which is open at a front, may be exposed to the supporter rear surface 342. The first water supply pipe 61 may be connected to an outlet 358 and extend rearward to be open at a rear.

A rear rim 348 extending rearward may be formed at an upper end and side ends of the supporter rear surface 342. A partition portion or wall 346 extending rearward may be formed on the supporter rear surface 342. The partition portion 346 may be connected to a rear rim 348 defining an upper surface and a side surface of the supporter rear surface 342 to form an arrangement space. An extending height of the partition portion 346 may correspond to a height of the rear rim 348. The fitting member 35 and the fixing member 36 may be provided inside the arrangement space formed by the partition portion 346.

The fixing member 36 may have a shape corresponding to that of the arrangement space and may be inserted through an open rear surface of the arrangement space. An outer circumferential surface of the fixing member 36 may be in close contact with inner surfaces of the rear rim 348 and the partition portion 346.

A through hole 361 through which the fitting member 35 passes may be formed in the fixing member 36. A shape of the through hole 361 may have a shape corresponding to an outer contour or shape of an outer surface of the fitting member 35. The fitting member 35 may be supported so as not to be separated from the tank supporter 34. The fixing member 36 may be formed of a heat insulating material such as styrofoam to prevent the fitting member 35, which may be provided relatively close to the upper evaporator 18, from being overcooled.

The fitting member 35 will be described in detail with reference to FIG. 6. The fitting member 35 may be formed to extend in the front-rear direction and may include a body portion 354 having a hollow or passage 350 such that water in the water tank 30 may pass through the body portion 354.

The front and rear surfaces of the body portion 354 may be formed with the inlet 352 through which water is introduced and the outlet 358 through which water is discharged such that front and rear surfaces of the body portion 354 are open. A size of the inlet 352 may be formed larger than a size of the outlet 358. The second water outlet 323 may be inserted into the inlet 352 or separated from the inlet 352 according to an attachment or detachment of the water tank 30. The end of the first water supply pipe 61 may be inserted and fixed to the outlet 358.

An inlet circumferential surface 351 extending outward may be formed around the inlet 352. The inlet circumferential surface 351 may be exposed at a front side through the supporter rear surface 342. A holding portion or lock protrusion 353 may be formed at a position spaced rearward from the inlet circumferential surface 351. The holding portion 353 may protrude outward along the circumference of the body portion 354. A holding groove 353*a* may be formed between the inlet circumferential surface 351 and the holding portion 353. The holding groove 353*a* may be formed along the circumference of the body portion 354.

When the fitting member 35 is mounted on the tank supporter 34, a circumference of the mounting hole may be provided in the supporter rear surface 342 between the inlet circumferential surface 351 and the holding portion 353. The mounting hole of the supporter rear surface 342 may be inserted into the holding groove 353*a*. The fitting member 35 may be fixed to the supporter rear surface 342, and the inlet 352 may be maintained at a state of being exposed at a front to allow insertion of the second outlet 323.

An inner diameter of the body portion 354 may narrow in the rearward direction. An initial insertion of the second water outlet 323 may be facilitated at a front side of the body portion 354. After the second water outlet 323 is inserted into the inlet 352, the second water outlet 323 may be concentric with the fitting member 35.

An inner rib 357 protruding inward may be formed inside the hollow 350. The inner rib 357 may be inclined toward the outlet 358 as the inner rib 357 protrudes inward and may have a thickness configured to be elastically deformable.

Interference when the second water outlet 323 is inserted may be reduced or prevented, and an outer surface of the second water outlet 323 may be pressed with the inner rib 357 by elastic deformation. The inner rib 357 may seal a space between the outer surface of the second outlet 323 and the hollow 350 so that water may be prevented from flowing back to the inlet 352 or so that the second outlet 323 may be prevented from being easily separated. A plurality of inner ribs 357 may be provided at predetermined or prescribed intervals in an insertion direction of the second outlet 323.

When the second outlet 323 is completely inserted into the hollow 350, a support end 359 supporting an end of the second outlet 323 may be formed. The support end 359 may be formed closer to the outlet 358 than the inner rib 357. A diameter of the hollow 350 may gradually decrease toward the support end 359. The second outlet 323 may be inserted a certain or prescribed amount to a position to be in contact with the support end 359.

A first clamp protrusion 356*a* and a second clamp protrusion 356*b* may be formed in the outer surface of the body portion 354. The first clamp protrusion 356*a* and the second clamp protrusion 356*b* may be positioned closer to the outlet 358 than the support end 359. When the fixing member 36 is mounted, the first and second clamp protrusions 356*a* and 356*b* may be exposed to an outside of the fixing member 36. The first clamp protrusion 356*a* may be formed at a position corresponding to a rear surface of the fixing member 36.

A clamp mounting portion or groove 356*c* may be formed between the first clamp protrusion 356*a* and the second clamp protrusion 356*b* to facilitate mounting of the clamp 38. The clamp mounting portion 356*c* may be formed to have a width corresponding to the width of the clamp 38. When the clamp 38 is mounted on the clamp mounting portion 356*c*, the first clamp protrusion 356*a* and the second clamp protrusion 356*b* may support ends of the clamp 38 to maintain the clamp 38 at a mounting position.

The clamp mounting portion 356*c* may be formed at an insertion position of the first water supply pipe 61 through the outlet 358. When the clamp 38 is mounted, the clamp 38 may press the circumference of the fitting member 35 so that the inner surface of the hollow 350 may press and closely contact the first water supply pipe 61. The first water supply pipe 61 may be firmly secured to the fitting member 35 to reduce or prevent separation. The clamp 38 may be referred to as a hose clamp, a hose band, and a tightening band. The clamp 38 may employ any one of various structures formed in a belt shape at an outer surface of the fitting member 35 to press the fitting member 35 and maintain the first water supply pipe 61 in the fitting member 35.

The inner diameter of the outlet 358 may be formed to be somewhat larger than or equal to the outer diameter of the first water supply pipe 61. The fitting member 35 may be formed of a material having elasticity. The fitting member 35 may be configured to allow the second outlet 323 and the first water supply pipe 61 to be press-fitted and in close contact with each other.

A tank switch 37 may detect whether the water tank 30 is mounted. A switch mounting portion 347 may be formed on a supporter rear surface 342, and the tank switch 37 may be mounted or installed at the switch mounting portion 347. The switch mounting portion 347 may be open such that a front of the tank switch 37 may be exposed. For example, the tank mounting portion 347 may be a recess. As an example, a portion of the tank switch 37 may be installed behind the tank mounting portion 347, and the tank switch 37 may pass through a wall or surface of the switch mounting portion 347 to protrude forward. When the water tank 30 is mounted, the tank switch 37 may detect a presence of the water tank 30.

An operation of the pump 51 may be determined according to a signal detected by the tank switch 37. For example, when the tank switch 37 detects a mounting signal of the water tank 30 indicating that the water tank 30 is present and/or mounted, the pump 51 may be driven. When the mounting signal of the water tank 30 is not detected, the pump 51 may not be driven.

An arrangement of the water tank 30 and the connection state of the first water supply pipe 61 will be described in more detail. Referring to FIG. 8, the upper evaporator 18 may be provided within a heat exchange space 183 defined by the inner case 102 and the evaporator cover 181. The water tank 30 may be positioned higher than the upper evaporator 18.

The evaporator cover 181 may have an upper end which is inclined. A space receiving a blower fan and a pipe connected to the upper evaporator 18 may be formed above the upper evaporator 18. Inclined surfaces of the water tank 30 and the tank supporter 34 may be formed to have inclinations corresponding to each other with the cover inclined surface 181*a*, and the water tank 30 and the tank supporter 34 may be provided so as to be close to the inner case 102 and close to the rear surface of the upper storage space 13.

The fitting member 35 may extend rearward, and an inner case opening 102*a* through which a rear of the fitting member 35 is exposed may be formed in the inner case 102. A lower opening 173 into which the first water supply pipe 61 is inserted may be formed in the back plate 17 on a same extension line as an outlet of the fitting member 35. The first water supply pipe 61 may be vertically inserted into the back plate 17 and connected to the outlet 358 of the fitting member 35 to reduce an extension length or path.

A pipe guide member 104 may be provided between the inner case 102 and the back plate 17. The pipe guide member 104 may form a pipe passage 104*a* through which the first water supply pipe 61 passes between the back plate 17 and the inner case 102.

The pipe guide member 104 may contact a front surface of the back plate 17 and a rear surface of the inner case 102 to prevent foaming liquid injected during injection molding of the heat insulating material 103 from being introduced to a passage into which the first water supply pipe 61 is inserted. The pipe guide member 104 may be formed of a heat insulating material such as styrofoam or expanded polystyrene and may insulate a portion through which the first water supply pipe 61 passes.

A portion of the front surface of the pipe guide member 104 may protrude forward and pass through the inner case opening 102*a*. A receiving groove 104*b* which is recessed rearward may be formed in the front surface of the pipe guide member 104 that has passed through the inner case opening 102*a*.

The receiving groove 104*b* may receive a rear end of the fitting member 35. The receiving groove 104*b* may be covered by the cold air duct 133. In the cold air duct 133, a portion corresponding to the rear end of the fitting member 35 may be open so that the first water supply pipe 61 or the fitting member 35 may pass through the cold air duct 133.

A pipe passage 104*a* may be formed in the pipe guide member 104. The pipe passage 104*a* may be formed to connect the receiving groove 104*b* and the lower opening 173 and allow the first water supply pipe 61 to pass through the pipe passage 104*a*. The pipe passage 104*a* may be located on a same extension line as the outlet 358 of the fitting member 35 and the lower opening 173. The first water supply pipe 61 connected to the fitting member 35 may be guided to an outside of the back plate 17 through the lower opening 173 to reduce an extension length or distance.

When the water tank 30 is mounted and the first water supply pipe 61 is connected to the fitting member 35, the fitting member 35 and the first water supply pipe 61 may not pass through a space where the upper evaporator 18 is provided. Such an arrangement may not only facilitate connection of the first water supply pipe 61 but also prevent or reduce overcooling by the upper evaporator 18. In addition, vibration noise caused due to interference between the first water supply pipe 61 and the upper evaporator 18 may be reduced or prevented.

The first water supply pipe 61 connected to the fitting member 35 may be easily guided to the outside of the back plate 17 by the pipe guide member 104 to facilitate the connection of the first water supply pipe 61. The first water supply pipe 61 may extend downward on the outside of the back plate 17 and may be connected to the pump 51 provided inside the machine room 40.

Figure 9:
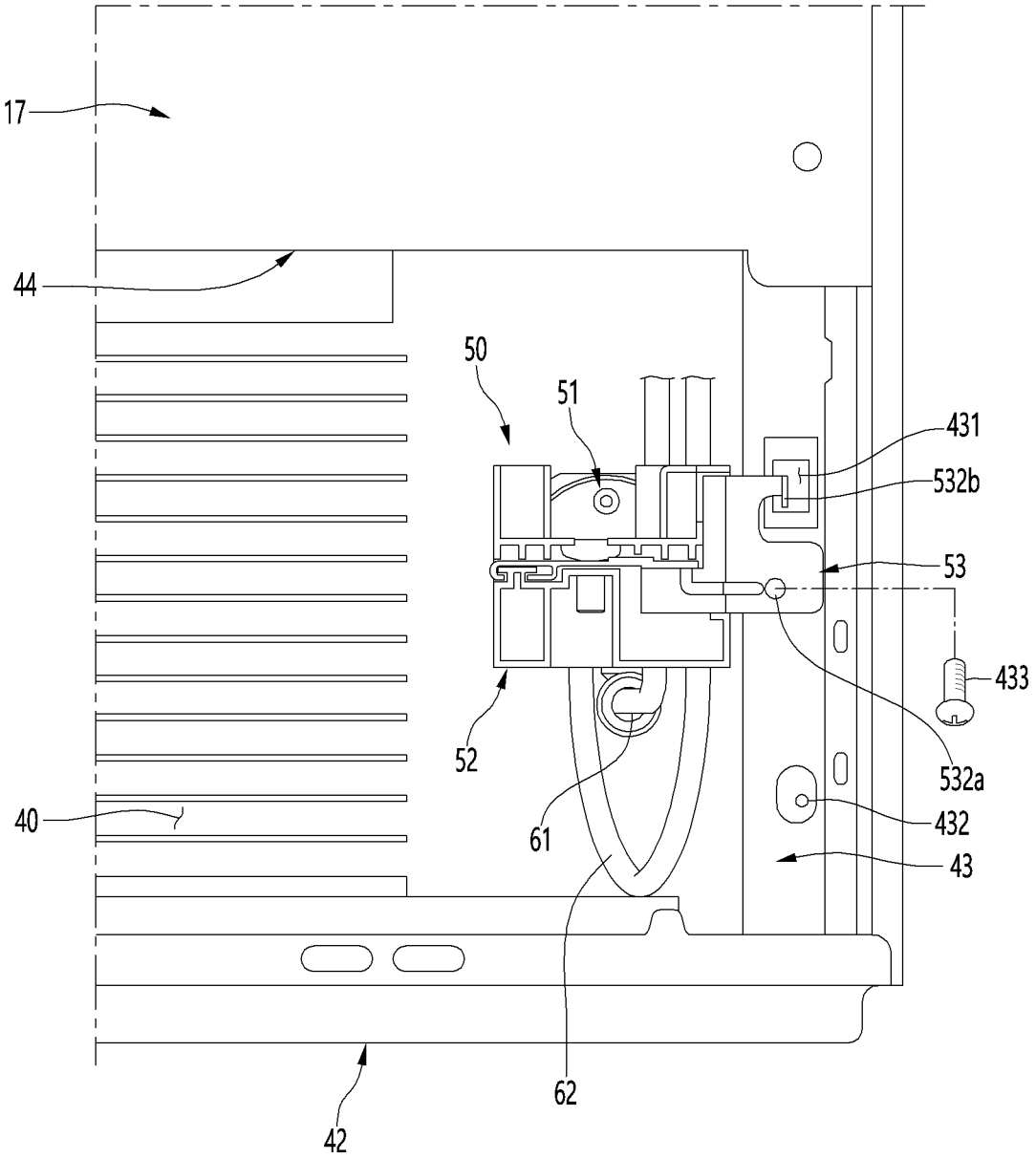
FIG. 9 is a view showing a state in which a pump assembly according to an embodiment is mounted in a machine room.
Figure 10:
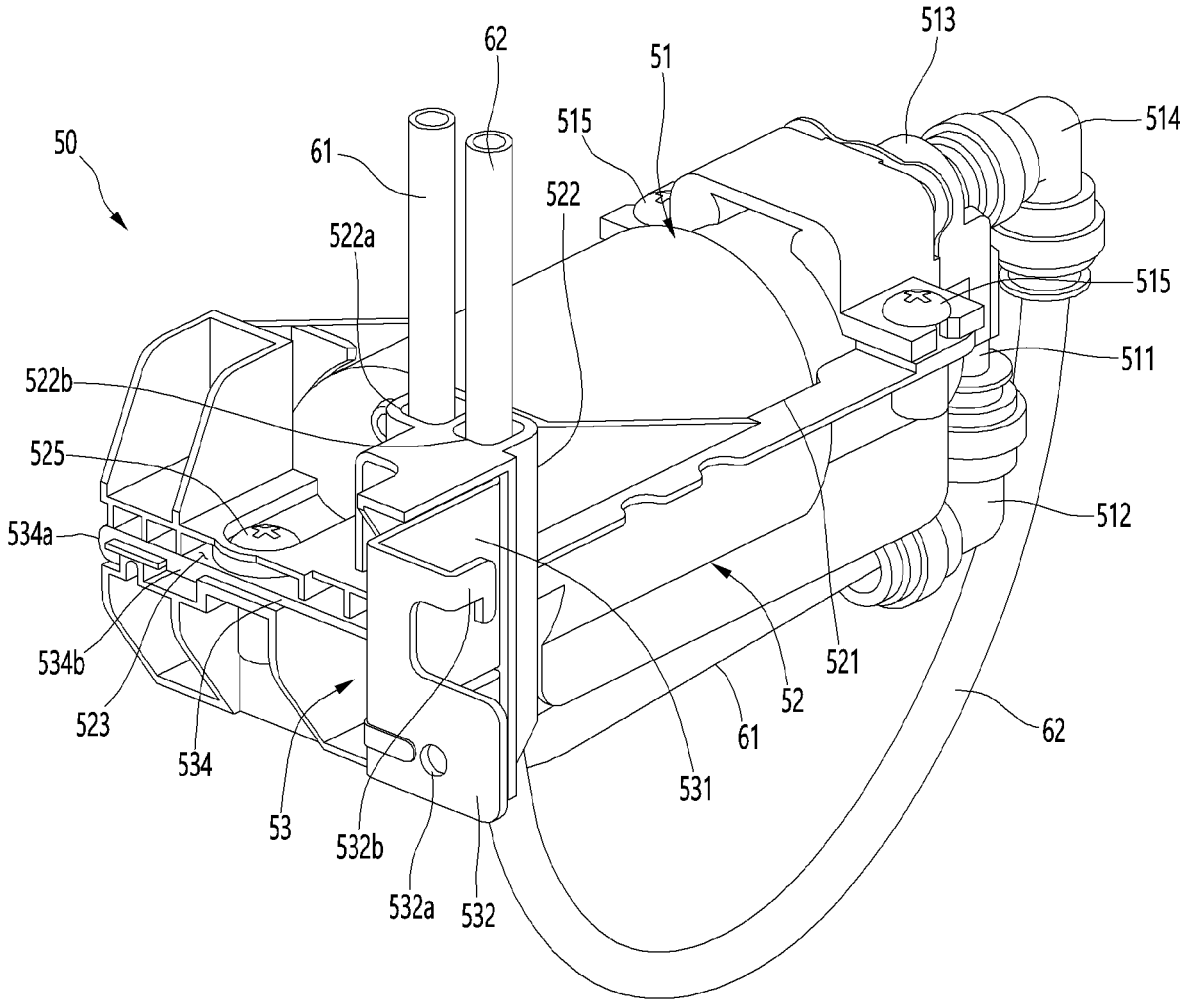
FIG. 10 is a perspective view of the pump assembly.
Figure 11:
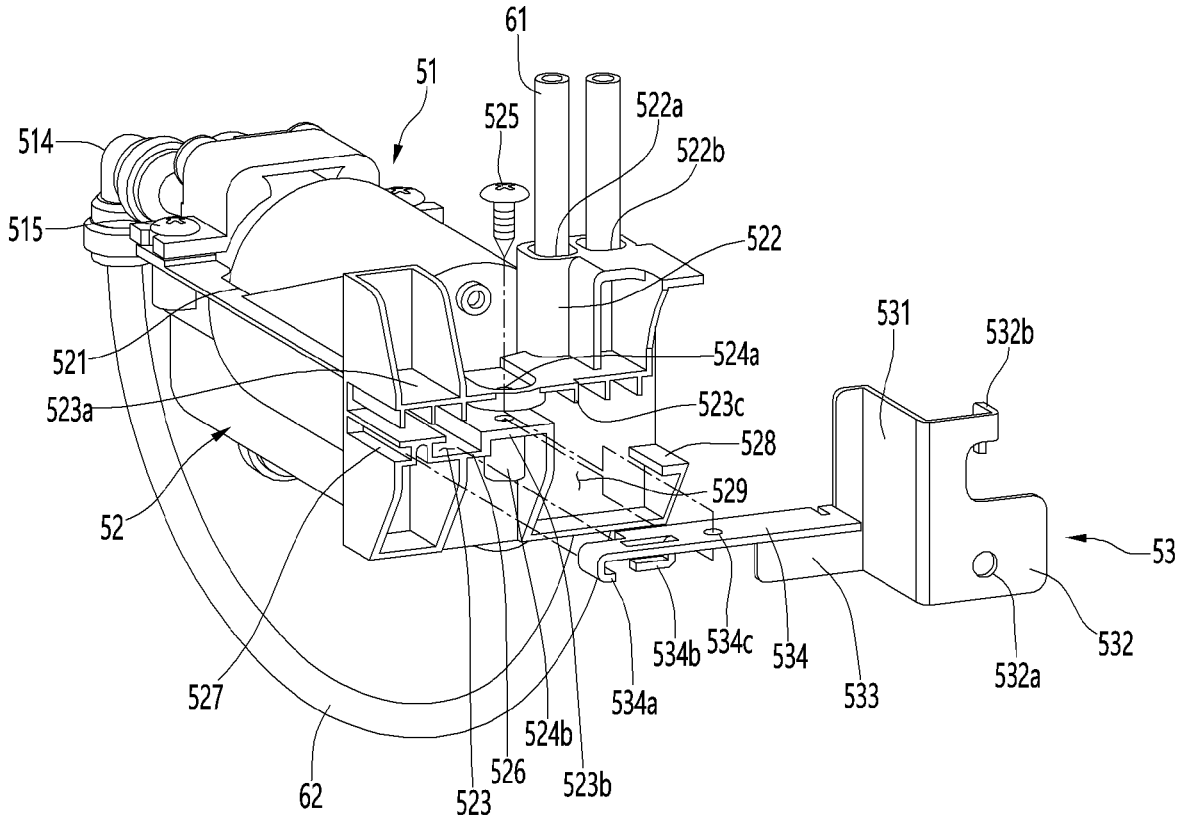
FIG. 11 is an exploded perspective view showing a coupling structure of a pump bracket of the pump assembly.

Hereinafter, the structure of the pump 51 will be described in more detail. Referring to FIGS. 9-11, the machine room 40 may include a bottom plate 42 defining a bottom surface and a top plate 44 defining an upper surface of the machine room 40. The machine room 40 may further include a side frame 43 extending downward from left and right sides of the machine room 40 and connected to the bottom plate 42. The side frame 43 may form rear ends of sides of the cabinet 10.

The machine room cover 41 may be coupled to a rear end of the side frame 43 and may shield an open rear surface of the machine room 40. A pump assembly 50 may be provided inside the machine room 40. The pump assembly 50 may be connected to the first water supply pipe 61 and the second water supply pipe 62. Water in the water tank 30 may be supplied to the dispenser 25 and the ice maker 262 inside the door 21 through the pump 51 by driving the pump 51.

The pump assembly 50 may be fixed at the side frame 43. When the pump assembly 50 is mounted, a portion of the pump assembly 50 may be exposed through the cover opening 411, and the first water supply pipe 61 and the second water supply pipe 62 may pass through the cover opening 411.

A holding groove 431 and a screw hole 432 may be formed in the rear side of the side frame 43. To mount the pump assembly 50, a bracket holding portion 532*b* to be described later may be inserted into the holding groove 341 and a screw 433 may be fastened to the screw hole 432.

The pump assembly 50 will be described in detail with reference to FIGS. 10 and 11. The pump assembly 50 may include the pump 51 that supplies water or other liquid from the water tank 30 to the dispenser 25 and ice maker 262, a pump case 52 in which the pump 51 is provided, and a pump bracket 53 that fixes the pump case 52 to the side frame 43. The pump case 52 may be configured to guide an arrangement of the first water supply pipe 61 and the second water supply pipe 62.

The pump 51 may be a water pump using a brushless motor and may have a compact size and durability. The pump 51 may have an input side 511 connected to the first water supply pipe 61 and an output side 513 connected to the second water supply pipe 62.

An input fitting 512 for connection with the first water supply pipe 61 may be further provided on the input side 511, and an output fitting 514 for connection with the second water supply pipe 62 may be further provided on the output side 513. The input side 511 and the output side 513 may be provided together at a same side of the pump 51 and be arranged to face the front of the machine room 40 to facilitate connection with the first water supply pipe 61 and the second water supply pipe 62.

The pump 51 may be seated on a pump seating portion 521 recessed in the pump case 52. The pump 51 and the pump case 52 may be to be coupled to each other by a fastening of a screw 525.

The pump case 52 may receive the pump 51 and simultaneously guide the first water supply pipe 61 and the second water supply pipe 62. The pump case 52 may be configured to be coupled to the pump bracket 53 to mount or install the pump assembly 50. The pump case 52 may be injection formed of a plastic material so as to have a structure configured to perform such a complex function.

A pipe fixing portion 522 to guide the first water supply pipe 61 and the second water supply pipe 62 may be formed at a side of the pump case 52 at a position opposite to the input side 511 and the output side 513. For example, the pipe fixing portion 522 may be formed on the front surface of the pump case 52.

The pipe fixing portion 522 may include a first through hole 522*a* through which the first water supply pipe 61 passes and a second through hole 522*b* through which the second water supply pipe 62 passes. The first through hole 522*a* and the second through hole 522*b* may be adjacent to each other and/or arranged side-by-side. The first and second through holes 522*a* and 522*b* may penetrate in the vertical direction.

The first water supply pipe 61 may be connected to the input side 511 by extending downward through the first through hole 522*a* and the second water supply pipe 52 connected to the output side 513 may extend upward and pass through the second through hole 522*b*.

The first water supply pipe 61 and the second water supply pipe 62 may be fixed at their positions by the pipe fixing portion 522. The pipe fixing portion 522 may prevent the first water supply pipe 61 and the second water supply pipe 62 from being separated from the pump 51 and prevent leaking at a portion connected to the pump 51.

An arrangement length of the second water supply pipe 62 between the second through hole 522*b* and the output side 513 may be adjusted by adjusting a length of the second water supply pipe 62 passing through the second through hole 522*b*. By allowing the water discharged from the pump 51 and passing through the second water supply pipe 62 to flow along the second water supply pipe 62, which may be arranged to have a gentle curvature from the pump 51, water supply to the dispenser 25 or the ice maker 262 may be smoother because a flow resistance of water output from the pump 51 may be reduced.

The first through hole 522*a* and the second through hole 522*b* may have inner diameters corresponding to the outer diameters of the first water supply pipe 61 and the second water supply pipe 62. The first water supply pipe 61 and the second water supply pipe 62 may be arranged at the rear surface of the cabinet 10 and inside the machine room 40 with a prescribed or appropriate tension.

A bracket mounting portion 523 may be formed at a front surface of the pump case 52. The bracket mounting portion 523 may be defined as a space between an upper surface 523*a* of the mounting portion and a lower surface 523*b* of the mounting portion.

The upper surface 523*a* of the mounting portion and the lower surface 523*b* of the mounting portion may be formed in a planar shape facing each other and may contact upper and lower surfaces of a coupling portion 534 of the pump bracket 53, respectively. The upper surface 523*a* of the mounting portion and the lower surface 523*b* of the mounting portion may extend in the horizontal direction. The coupling portion 534 may be inserted into the bracket mounting portion 523 formed between the upper surface 523*a* of the mounting portion and the lower surface 523*b* of the mounting portion to secure the pump case 52 and the pump bracket 53.

The upper surface 523*a* of the mounting portion may extend from a left end to a right end of the front surface of the pump case 52. A bracket fastening hole 524*a* may be formed in a center of the upper surface 523*a* of the mounting portion. A screw 525 fastened to the bracket fastening hole 524*a* may be fastened to a fastening boss 524*b* of the lower surface 523*b* of the mounting portion by passing through the coupling portion 534.

A plurality of mounting ribs 523*c* extending downward may be formed on the upper surface 523*a* of the mounting portion. A plurality of the mounting ribs 523*c* may be formed at regular or prescribed intervals in the left and right directions. The extending lower ends of the mounting ribs 523*c* may support the upper surface of the coupling portion 534.

The lower surface 523*b* of the mounting portion may extend from the left end of the front surface of the pump case 52 in a horizontal direction and may be formed shorter than the upper surface 523*a* of the mounting portion. The fastening boss 524*b* may be formed on the lower surface 523*b* of the mounting portion. The fastening boss 524*b* may be formed at a position facing the bracket fastening hole 524*a*.

A side-end holding groove 527 may be recessed at a left end of the lower surface 523*b* of the mounting portion and a lower holding groove 526 may be further formed in the lower surface of the mounting portion 523*b*. A bracket receiving portion or space 529 may be formed at a side of the lower surface 523*b* of the mounting portion, and a side support rib 528 may be formed at a right end of the front surface of the pump case 52.

The pump bracket 53 may be formed by bending a plate-shaped metal material. A side of the pump bracket 53 may be coupled to the front surface of the pump case 52, another side of the pump bracket 53 may be coupled to the side frame 43.

The pump bracket 53 may include a first support surface 531 that is in contact with an inner surface of the side frame 43 and a second support surface 532 that is in contact with a rear surface of the side frame 43. The first support surface 531 and the second support surface 532 may be bent to be perpendicular to each other. The pump bracket 53 may remain seated on the inner surface and the rear surface of the side frame 43 when mounted.

The second support surface 532 may have a bracket holding portion 532*b* that is formed to be bent rearward in the shape of a hook. The bracket holding portion 532*b* may be inserted into a holding groove 431 of the side frame 43 and held and restrained by the side frame 43. A bracket screw hole 532*a* extending to a side may be formed below the bracket holding portion 532*b*. A screw 433 passing through the bracket screw hole 532*a* may be fastened to the screw hole 432 in the rear surface of the side frame 43 so that the pump bracket 53 may remain firmly fixed to the side frame 43.

A bracket bent portion or plate 533 may be bent in a direction opposite to the second support surface 532 and formed at a front end of the first support surface 531. The bracket bent portion 533 may be inserted into the bracket receiving portion 529, and a side end of the bracket bent portion 533 may be supported by the side support rib 528. The bracket bent portion 533 may be positioned inside the recessed bracket receiving portion 529. An outer surface of the bracket bent portion 533 may contact the inner surface of the bracket receiving portion 529 so that the pump bracket 53 and the pump case 52 may be rigidly coupled to each other.

The bracket bent portion 533 may include a coupling portion or frame 534 bent forward. The coupling portion 534 may be formed to have a thickness or length configured to be inserted into the bracket mounting portion 523 and may extend through the bracket mounting portion 523 to protrude to the left. The coupling portion 534 may be inserted into the bracket mounting portion 523 while moving rearward.

A bracket through hole 534*c* may be formed in the coupling portion 534 at a position corresponding to the bracket fastening hole 524*a*. The screw 525 that fixes the pump bracket 53 may pass through the bracket fastening hole 524*a* and the bracket through hole 534*c* to be shielded and may be fastened to the fastening boss 524*b*.

A side-end holding portion or hook 534*a* may be formed at an extending end (i.e., a left end) of the coupling portion 534. The side-end holding portion 534*a* may be continuously bent downward and rightward. The side-end holding portion 534*a* may be inserted into the side-end holding groove 527 when the coupling portion 534 is inserted into the bracket mounting portion 523. An end of the pump bracket 53 and the side end of the pump case 52 may be coupled to each other by the coupling between the side-end holding portion 534*a* and the side-end holding groove 527.

A lower surface holding portion or hook 534*b* protruding downward and extending to the left may be formed between the side-end holding portion 534*a* and the bracket through hole 534*c*. The lower surface holding portion 534*b* may be inserted into the lower surface holding groove 526 when the coupling portion 534 is inserted into the bracket mounting portion 523. The pump bracket 53 and the pump case 52 may be coupled to each other by the coupling between the lower surface holding portion 534*b* and the lower surface holding groove 526.

When the coupling portion 534 is inserted from the front to the rear of the bracket mounting portion 523, the side-end holding portion 534*a* and the lower surface holding portion 534*b* may be slidably inserted into and coupled to the side-end holding groove 527 and the lower surface holding groove 526. The pump bracket 53 may be maintained to be firmly coupled to the pump case 52 even when the pump bracket 53 is mounted on the side frame 43.

In the refrigerator 1 having the above structure, water in the water tank 30 may be supplied to the dispenser 25 and the ice maker 262 through the water supply passage 60. Hereinafter, a state in which water flows through the water supply passage 60 will be described with reference to FIG. 12.

Figure 12:
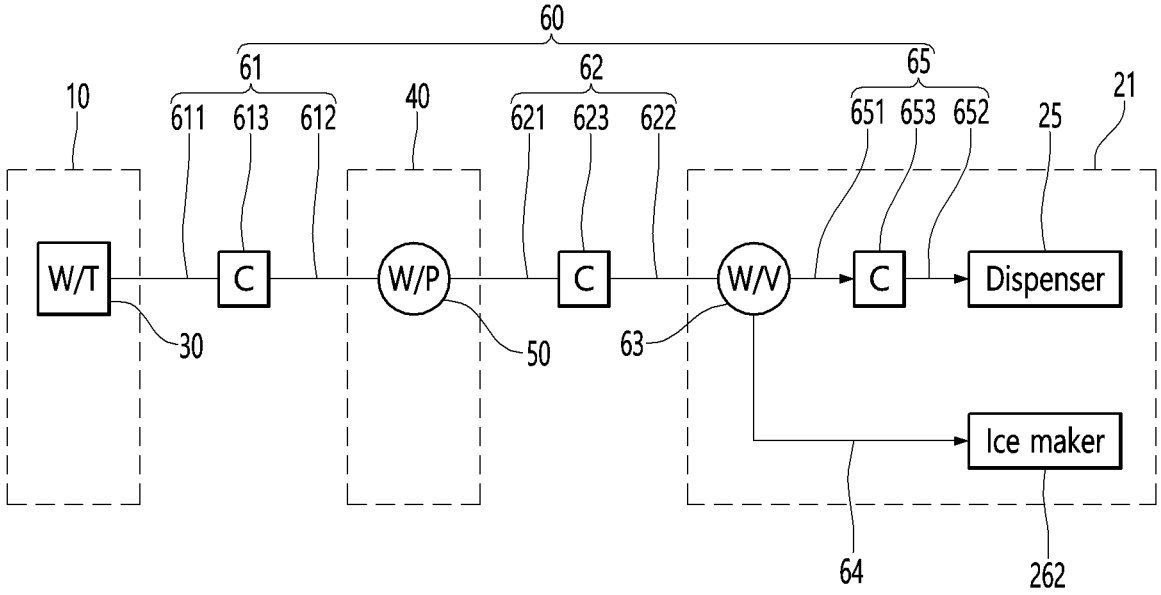
FIG. 12 is a diagram schematically illustrating connection of an entire passage and a water flow of the passage.

Referring to FIG. 12, the water supply passage 60 may include the first water supply pipe 61, the second water supply pipe 62, the third water supply pipe 64, and the fourth water supply pipe 65. The water tank 30 inside the upper storage space 13 may be connected to and the pump 51 inside the machine room 40 by the first water supply pipe 61. The first water supply pipe 61 may include a tank side pipe 611 connected to the water tank 30 and an input side pipe 612 connected to the input side 511 of the pump 51. The tank side pipe 611 may be guided to the rear of the back plate 17 through the pipe guide member 104 and the lower opening 173. The input side pipe 612 connected to the pump 51 in the machine room 40 may be exposed to the rear of the back plate 17.

The tank side pipe 611 and the input side pipe 612 may be connected to each other by a first connector 613 outside the cabinet 10 at the rear the back plate 17. The first connector 613 may be a fitting or coupler in which the tank side pipe 611 and the input side pipe 612 are respectively inserted through both ends thereof and connected to each other.

The pump inside the machine room 40 and the branch valve 63 inside the door 21 may be connected by the second water supply pipe 62. The second water supply pipe 62 may include an output side pipe 621 connected to the output side 513 of the pump 51 and a valve side pipe 622 connected to the branch valve 63 inside the door 21. The output side pipe 621 connected to the pump 51 in the machine room 40 may be exposed to the rear of the back plate 17. The valve side pipe 622 may pass through the hinge 161 from the inside of the door 21, pass by the upper surface of the cabinet 10, and be exposed to the outside of the back plate 17 through the upper opening 171.

The output side pipe 621 and the valve side pipe 622 may be connected to each other by a second connector 623 outside the cabinet 10 at the rear the back plate 17. The second connector 623 may be a fitting or coupler in which the output side pipe 621 and the valve side pipe 622 are respectively inserted through both ends thereof and connected to each other.

The third water supply pipe 64 connected to the branch valve 63 may connect the branch valve 63 and the ice maker 262 in the inside of the door 21. The fourth water supply pipe 65 may include a valve output pipe 651 connected to the branch valve 63 and a dispenser input pipe 652 connected to the dispenser 25.

During an assembly process of the dispenser 25, the valve output pipe 651 and the dispenser input pipe 652 may be connected to each other by a third connector 653. The third connector 653 may be a fitting or coupler in which the valve output pipe 651 and the dispenser input pipe 652 are respectively inserted through both ends thereof and connected to each other.

The water flow in the refrigerator 1 having the above-described structure will be described. The user opens the door 21 to view the water tank 30 and, when the user and/or an optional water level sensor determines that a water level is insufficient, the water tank 30 may be filled with water. When a water supply signal is generated for the ice maker 262 or the dispenser 25 while the water tank 30 is filled with water, the pump 51 may be driven.

When the pump 51 is driven, water in the water tank 30 may be suctioned into the pump 51 provided in the machine room 40 along the first water supply pipe 61. Water discharged from the pump 51 may be guided to the branch valve 63 inside the door 21 along the second water supply pipe 62. The branch valve 63 may be switched according to an input signal, and a supply of water to the dispenser 25 or the ice maker 262 is completed through the fourth water supply pipe 64 or the third water supply pipe 65.

Embodiments disclosed herein may provide a refrigerator in which a water tank is provided inside an upper storage space to allow the user to easily supply water, thereby improving convenience and facilitating a supply of clean and purified water to a dispenser and an ice maker. Since the pump connected to the water tank may be provided inside the machine room rather than the storage space inside the refrigerator, a user may not readily access the pump, enhancing safety.

The dispenser and ice maker may be provided in a left (or alternatively, right) upper door of a French door having doors at both left and right sides. The water tank and the pump are provided at the left (or alternatively, right) side of the storage space and the machine room to be on a same side of the refrigerator as the dispenser and the ice maker so that water supply passages extending through the water tank and the pump to the upper door are all arranged at a same (e.g., left) side of the cabinet, reducing a path of the water supply passage, achieving efficient arrangement, and improving assembly workability.

The water tank may be provided above the upper evaporator provided in the upper storage space, and a fitting member and the water supply passage connected to the water tank may be provided so as not to pass by the evaporator or the space in which the evaporator is provided, preventing water supplied from the water tank and inside the water tank from being overcooled. The fitting member connected to the water tank and the opening in the rear surface of the cabinet may be arranged on the same extension line so that the water supply passage may be connected through the cabinet via a relatively small or minimum distance, thereby simplifying a passage structure.

A pipe guide member already formed of a heat insulating material may be further provided inside the cabinet, and the water supply passage may facilitate arrangement and connection of the water supply passage by the pipe guide member without being affected by a foaming liquid filled in the cabinet. The arrangement of the water supply passage may be configured in such a way that the pipe passage of the pipe guide member connects the fitting member and the opening of the rear surface of the cabinet in a straight line.

The pump assembly may be provided inside the machine room, and at least a portion of the pump assembly may be exposed through a cover opening of the machine room cover to facilitate the arrangement of the water supply passage. An upper opening, a lower opening of the rear surface of the cabinet, and the cover opening through which the water supply passage passes may be arranged or aligned up and down on the same extension line so that the water supply passage may be efficiently arranged, and connection work of the water supply passage may be facilitated.

The pump assembly may be fixedly mounted to a side frame of the machine room by a pump bracket and be rigidly and fixedly mounted inside the machine room. A pipe fixing portion to fix a first water supply pipe and a second water supply pipe connected to the pump may be formed in the pump assembly. A reliability of operation may be secured by allowing the first water supply pipe and the second water supply pipe to be connected to the pump to be aligned at accurate positions and to be maintained in the mounted state.

An input side and an output side of the pump may be arranged at positions opposite to the pipe fixing portion so that the second water supply pipe may have a gentle curvature by adjusting the length of the second water supply pipe connected to the pump. A flow resistance of water discharged from the pump may be reduced or minimized.

Embodiments disclosed herein may provide a refrigerator having an arrangement structure of a water tank and a pump capable of securing convenience and stability in use at the same time. The refrigerator may be capable of reducing or minimizing a path between a water tank and a pipe.

Embodiments disclosed herein may provide a refrigerator in which a water tank inside of the refrigerator and an evaporator to cool the inside of the refrigerator do not interfere with each other. The refrigerator may have improved installation and assembly convenience.

Embodiments disclosed herein may provide a refrigerator which includes a cabinet defining an upper storage space and a lower storage space, a machine room provided at a lower end of the cabinet, a compressor and a condenser provided in the machine room, an upper door configured to open and close the upper storage space, a lower door configured to open and close the lower storage space, a dispenser provided in the upper door to dispense water or liquid, an ice maker provided inside the upper door and configured to make ice, a water tank provided in the upper storage space, a pump assembly provided inside the machine room and configured to forcibly supply water from the water tank to the dispenser and the ice maker, and a water supply passage configured to guide water from the water tank to the dispenser and the ice maker through the pump assembly. The water supply passage may extend downward from the water tank after passing through a rear surface of the cabinet to connect to the pump assembly inside the machine room and extend upward from the pump assembly to pass through an upper surface of the cabinet to connect to the dispenser and the ice maker.

The upper door may include an upper left door and an upper right door that are rotatably provided at both left and right sides respectively. The dispenser and ice maker may be provided in either the upper left door or the upper right door, and the water tank, the pump assembly, and the water supply passage may be all provided on one of left and right sides of the cabinet on which the dispenser and ice maker are provided.

The rear surface of the cabinet may be configured as a back plate, an upper opening, and a lower opening through which the water supply passage passes formed in the back plate. A machine room cover that shields an open rear surface of the machine room may be formed with a cover opening that is open to connect the pump assembly and the water supply passage. The upper opening, the lower opening, and the cover opening may be arranged vertically on an identical extension line.

The upper storage space may be a refrigerating chamber. An additional heat insulation space may be formed inside the upper storage space and/or the upper door. The ice maker may be provided inside the heat insulation space.

The refrigerator may further include an upper evaporator provided on a rear wall of the upper storage space and an evaporator cover shielding the upper evaporator. The water tank may be provided above the upper evaporator.

A cover inclined surface facing a rear as it extends upward may be formed on an upper portion of the evaporator cover. An inclined surface corresponding to the cover inclined surface may be formed at a lower end of a rear surface of the water tank.

The refrigerator may further include a drawer mounted in the upper storage space so as to be withdrawn in and out of the upper storage space and provided in front of the evaporator and a plurality of shelves spaced from each other on an upper side of the drawer. The water tank may be provided in a space defined by an upper surface of the drawer, a lower surface of a shelf, and a side wall of the upper storage space.

The refrigerator may further include a tank supporter provided in the upper storage space. The water tank may be detachably mounted on the tank supporter and connected to the water supply passage when the water tank is mounted on the tank supporter.

The water tank may include a water outlet extending rearward. Water inside the water tank may be discharged through the water outlet. The tank supporter may include a fitting member into which the water outlet is inserted and communicates with the water supply passage.

The rear surface of the cabinet may be formed with an opening into which the water supply passage is inserted. The opening, an extending end of the water outlet, and the fitting member may be provided on an identical extension line.

The water tank may include a tank body configured to accommodate water and a tank cover configured to open and close an open upper surface of the tank body. The water outlet may include a first outlet extending downward from the tank cover and a second outlet extending rearward from an upper end of the first outlet and connected to the fitting member. Water inside the tank body may be suctioned through the first outlet. The refrigerator may further include a fixing member formed of a heat insulating material and provided on a rear surface of the tank supporter to fix the fitting member in a way that the fitting member passes through the fixing member.

The cabinet may include an outer case configured to define an appearance, an inner case configured to define the upper storage space, a back plate configured to define a rear surface, and a heat insulating material formed by filling, with a foaming liquid, a space between the outer case and the inner case, and the back plate. A pipe guide member may be assembled between the inner case and the back plate in a state of being formed of a heat insulating material and be formed with a pipe passage through which the water supply passage passes.

The pipe guide member may protrude through the inner case, and the pipe guide member may have a receiving groove in which an end of the fitting member is received, and the receiving groove may communicate with the pipe passage. An outlet of the fitting member and an opening in the rear surface of the cabinet into which the pipe passage and the water supply passage may be inserted may be formed on an identical extension line.

The water supply passage may include a first water supply pipe configured to connect the water tank and the pump assembly and a second water supply pipe connected to the pump assembly and the ice maker and the dispenser. The first water supply pipe and the second water supply pipe may be arranged side by side in the rear surface of the cabinet.

The pump assembly may include a pump connected to the first water supply pipe and the second water supply pipe, a pump case configured to receive the pump, and a pump bracket extending from the pump case to fix the pump case to the machine room. The pump case may be formed with a pipe fixing portion exposed through a cover opening formed in the machine room cover in the rear surface of the machine room to fix the first water supply pipe and the second water supply pipe in a way that the first water supply pipe and the second water supply pipe pass through the pipe fixing portion side by side.

An input portion to which the first water supply pipe is connected and an output portion to which the second water supply pipe is connected may be formed in a front surface of the pump opposite to the pipe fixing portion. One end of the pump bracket may be coupled to the pump case, and the other end of the pump bracket may be coupled to a side frame defining a side surface of the machine room.

Embodiments disclosed herein may be implemented as a refrigerator comprising a cabinet defining a first storage space and a second storage space, the first storage space provided above or below the second storage space, a machine room provided at a lower end of the cabinet and housing a compressor and a condenser, a first door configured to open or close the first storage space, a second door configured to open or close the second storage space, a device provided in the first door, the device being at least one of a liquid dispenser configured to dispense liquid or an ice maker configured to make ice, a tank provided in the first storage space and configured to store liquid, a supply passage configured to guide liquid from the tank to the device, and a pump assembly provided inside the machine room and configured to pump liquid from the tank through the supply passage to the device. The supply passage may extend through a rear surface of the cabinet to connect to the pump assembly inside the machine room. The supply passage may extend through one of an upper surface or a lower surface of the cabinet to connect the pump assembly to the device.

The first door may include a left door and a right door that are rotatably provided at left and right sides of the cabinet, respectively. The device may be provided in the left door or the right door. The tank, the pump assembly, the supply passage, and the device may be provided at a same side of the cabinet, the same side being one of the left and right sides of the cabinet.

The rear surface of the cabinet may be configured as a back plate having an upper opening and a lower opening, the supply passage passing through the upper and lower openings. A machine room cover may cover an open rear surface of the machine room and may be formed with a cover opening to connect the pump assembly and the supply passage. The upper opening, the lower opening, and the cover opening may be vertically aligned.

The first storage space may be a refrigerating chamber. A heat insulation space may be formed inside the first door. The device may include the ice maker, and the ice maker may be provided inside the heat insulation space.

A first evaporator may be provided at a rear of the first storage space. An evaporator cover may cover the first evaporator. The tank may be provided above the first evaporator.

An upper surface of the evaporator cover may include an inclined surface inclined rearward in an upward direction. A rear surface of the tank may include an inclined surface having an inclination corresponding to an inclination of the inclined surface of the evaporator cover such that the tank may be configured to be seated against the evaporator cover.

At least one drawer may be provided in the first storage space and configured to be withdrawn in or out of the first storage space. The drawer may be provided in front of the evaporator. A plurality of shelves may be spaced from each other above the drawer. The tank may be provided between the drawer and the shelves.

A support may be provided in the first storage space and configured to receive at least a portion of the tank. The tank may be configured to be removably coupled to the support. When the tank is coupled to the support, the tank may be connected to the supply passage.

The tank may include an outlet extending rearward to discharge liquid in the tank. The support may include a fitting member into which the outlet may be configured to be inserted to communicate with the supply passage.

The rear surface of the cabinet may include an opening into which the supply passage may be inserted. The opening, an extending end of the outlet, and the fitting member may be aligned in a front-rear direction.

The tank may include a body configured to receive liquid and a cover configured to open or close an upper opening of the body. The outlet may include a first outlet extending downward from the cover through which liquid inside the body may be suctioned, and a second outlet extending rearward from an upper end of the first outlet and configured to connect to the fitting member.

A heat insulating material may be provided on a rear surface of the support. The fitting member may be configured to pass through the heat insulating material such that a position of the fitting member may be maintained by the heat insulating material.

The cabinet may include an outer case configured to define an exterior appearance, an inner case configured to define the first storage space, a back plate configured to define a rear surface, a first heat insulating material formed by filling, with a foaming liquid, a space between the outer case, the inner case, and the back plate, and a pipe guide formed of a second heat insulating material and provided between the inner case and the back plate, the pipe guide having a pipe passage through which the supply passage passes.

The pipe guide may protrude through the inner case and may have a receiving groove in which an end of the fitting member may be received. The receiving groove may communicate with the pipe passage.

An opening may be provided in the rear surface of the cabinet through which the pipe passage and the supply passage are inserted. An outlet of the fitting member and the opening may be aligned in a front-rear direction.

The supply passage may include a first supply pipe configured to connect the tank and the pump assembly, and a second supply pipe connected to the pump assembly and the device. The first and second supply pipes may be arranged to be adjacent to each other in the rear surface of the cabinet.

The pump assembly may include a pump connected to the first supply pipe and the second supply pipe, a pump case configured to receive the pump, and a pump bracket extending from the pump case to fix the pump case to the machine room.

The machine room may be covered by a machine room cover. The machine room cover may include a cover opening. The pump case may include a pipe fixing case exposed through the cover opening and configured to maintain adjacent positions of the first supply pipe and the second supply pipe.

The pump may include an input side to which the first supply pipe may be connected and an output side to which the second supply pipe may be connected. The input and output sides may be formed at a front surface of the pump which may be opposite to a surface of the pump that faces the pipe fixing case.

A first end of the pump bracket may be coupled to the pump case. A second end of the pump bracket may be coupled to a side frame defining a side surface of the machine room.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet;

a refrigerating storage space positioned at an upper portion of the cabinet;

a freezing storage space positioned at a lower portion of the cabinet;

a machine room positioned at the lower portion of the cabinet;

a door configured to open or close the refrigerating storage space, and wherein the door includes a left door that is rotatably disposed on a left side of the cabinet, and a right door that is rotatably disposed on a right side of the cabinet;

a water dispenser disposed at one of the left door and the right door;

a water tank disposed in the refrigerating storage space and configured to store water;

an ice maker configured to provide ice based on water supplied from the water tank;

a pump disposed within the machine room and configured to supply water from the water tank to the dispenser and to the ice maker;

a branch valve disposed at the one of the left door and the right door and configured to selectively supply water from the water tank to the dispenser and to the ice maker;

a first water supply passage configured to guide water from the water tank to the pump;

a second water supply passage configured to guide water from the pump to the branch valve;

a first connector to connect parts of the first water supply passage; and a second connector to connect parts of the second water supply passage, wherein the first connector and the second connector are disposed at a rear of the cabinet, wherein the water tank, the pump, the branch valve, and the first and second water supply passages are all disposed on a same side of the cabinet as the dispenser and the ice maker, and wherein an upper opening is formed on a rear surface of the cabinet, and a lower opening is formed on the rear surface of the cabinet, the second water supply passage is to pass through the upper opening and the first water supply passage is to pass through the lower opening, a cover opening is formed on a machine room cover that covers an open rear surface of the machine room, and the cover opening is configured to connect the pump and the first and second water passages; and the upper opening, the lower opening, and the cover opening are vertically aligned along a same extension line.

2. The refrigerator according to claim 1, wherein the ice maker is provided on the one of the left door and the right door.

3. The refrigerator according to claim 1, wherein the door includes an ice making chamber provided at a rear side of the door, and the ice making chamber is configured to provide a heat insulating space, and the ice maker is disposed in the heat insulating space.

4. The refrigerator according to claim 1, wherein the first water supply passage includes:

a tank pipe to connect to the water tank; and an input pump pipe to connect to an input of the pump, and the first connector is disposed at a back plate of the cabinet to connect the tank pipe to the input pump pipe.

5. The refrigerator according to claim 4, wherein the second water supply passage includes:

an output pump pipe to connect to an output of the pump; and a valve pipe to connect to the branch valve, and the second connector is disposed at the back plate to connect the output pump pipe to the valve pipe.

6. The refrigerator according to claim 5, comprising a third connector disposed between the branch valve and the dispenser, and the third connector is to couple a valve output pipe connected to the branch valve to a dispenser input pipe connected to the dispenser.

7. The refrigerator according to claim 1, comprising a tank supporter disposed in the refrigerating storage space and configured to support the water tank, wherein the water tank is configured to be removably coupled to the tank supporter, and when the water tank is coupled to the tank supporter, the water tank is connected to the first water supply passage.

8. The refrigerator according to claim 7, wherein the tank supporter includes a fitting member to extend through a surface of the tank supporter, and the water tank includes a water outlet to extend rearward to discharge water from the water tank; and the water outlet is configured to couple to the fitting member in order to communicate with the first water supply passage.

9. The refrigerator according to claim 8, wherein the fitting member includes:

an inlet to receive the water outlet of the water tank, and an outlet to protrude to rear of the tank supporter and to couple to the first water supply passage.

10. The refrigerator according to claim 8, wherein a fixing member is disposed at rear of the tank supporter, and the fixing member is formed of a heat insulating material, and the fitting member is to pass through the fixing member such that the fixing member surrounds the fitting member.

11. The refrigerator according to claim 10, wherein the cabinet includes:

an outer case configured to define an exterior;

an inner case configured to define the refrigerating storage space;

a back plate; and a pipe guide formed of a heat insulating material and coupled between the inner case and the back plate, and the pipe guide includes a pipe passage through which the first water supply passage is to pass.

12. The refrigerator according to claim 11, wherein the pipe guide includes a receiving groove at a front of the pipe guide to receive a rear of the fitting member, and the pipe guide is to pass through an opening of the inner case.

13. The refrigerator according to claim 11, wherein space between any of the outer case, the inner case, and the back plate includes an insulator formed with a foaming liquid, and the insulator is to surround the pipe guide.

14. The refrigerator according to claim 7, comprising:

a first evaporator disposed at a rear of the refrigerating storage space and disposed lower than the water tank; and an evaporator cover to cover the first evaporator, and wherein an upper surface of the evaporator cover includes an inclined surface that is inclined rearward in an upward direction, and a rear surface of the tank supporter includes an inclined surface having an inclination corresponding to an inclination of the inclined surface of the evaporator cover such that the water tank is configured to be seated against the evaporator cover.

15. The refrigerator according to claim 1, wherein the pump is connected to the first water supply passage and the second water supply passage, and the refrigerator comprises:

a pump case configured to receive the pump; and a pump bracket configured to attach the pump case to the machine room, the pump case is to extend in a front and rear direction in the machine room.

16. The refrigerator according to claim 15, wherein the pump including an input part to connect to the first water supply passage and an output part to connect to the second water supply passage, and the input part and the output part are disposed at a front of the pump opposite to the cover opening.

17. The refrigerator according to claim 16, wherein a pipe fixing portion is disposed at a rear of the pump case opposite to the input part and the output part and configured to guide the first water supply passage and the second water supply passage, and the first water supply passage and the second water supply passage extend from the input part and the output part upward through a hole of the pipe fixing portion.

18. The refrigerator according to claim 15, wherein a first end of the pump bracket is coupled to the pump case, and a second end of the pump bracket is coupled to a side of the machine room.

* * * * *